US008019252B2

(12) United States Patent
Funada et al.

(10) Patent No.: US 8,019,252 B2
(45) Date of Patent: Sep. 13, 2011

(54) REMOVABLE MEMBER-HOLDING DEVICE AND IMAGE FORMING APPARATUS

(75) Inventors: Atsushi Funada, Kanagawa (JP); Hiroaki Okuma, Kanagawa (JP); Hirokazu Murase, Kanagawa (JP); Ryuji Hattori, Kanagawa (JP); Junichi Hama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 84 days.

(21) Appl. No.: 12/549,165

(22) Filed: Aug. 27, 2009

(65) Prior Publication Data

US 2010/0215395 A1 Aug. 26, 2010

(30) Foreign Application Priority Data

Feb. 26, 2009 (JP) ..... P2009-044616
Mar. 19, 2009 (JP) ..... P2009-068904
Mar. 19, 2009 (JP) ..... P2009-068919
Mar. 19, 2009 (JP) ..... P2009-068938

(51) Int. Cl.
*G03G 15/00* (2006.01)
*G03G 15/08* (2006.01)

(52) U.S. Cl. ..... 399/110; 399/107; 399/258; 399/262

(58) Field of Classification Search ..... 399/107, 399/110, 119, 258, 262
See application file for complete search history.

(56) References Cited

U.S. PATENT DOCUMENTS 5,822,663 A * 10/1998 Ichikawa et al. ..... 399/262
5,828,935 A * 10/1998 Tatsumi et al. ..... 399/258 X
5,867,757 A * 2/1999 Okazaki et al. ..... 399/262
6,594,458 B2 * 7/2003 Ban et al. ..... 399/258 X
6,871,034 B2 * 3/2005 Muramatsu et al. ..... 399/258 X
6,882,817 B2 * 4/2005 Kita ..... 399/258
7,116,931 B2 * 10/2006 Yamada et al. ..... 399/262
7,133,629 B2 * 11/2006 Kita ..... 399/258
7,389,071 B2 * 6/2008 Katsuyama et al. ..... 399/258
7,720,405 B2 * 5/2010 Okabe ..... 399/107 X
7,720,411 B2 * 5/2010 Itabashi ..... 399/110

FOREIGN PATENT DOCUMENTS

JP 10-213959 8/1998
JP 11-143190 5/1999
JP 2000-275946 10/2000
JP 2003-66705 3/2003
JP 2003-114568 4/2003
JP 2003-295591 10/2003
JP 2004-126407 4/2004
JP 2006-78627 3/2006
JP 2006-215239 8/2006
JP 3952705 5/2007

* cited by examiner

*Primary Examiner* — Sandra L Brase
(74) *Attorney, Agent, or Firm* — Morgan, Lewis & Bockius LLP

(57) ABSTRACT

A removable member-holding device is provided and includes: a pull-out member being movably between an accommodating position and a pull-out position; a holding member supported on the pull-out member and having a holding member body, the holding member being extended in a moving direction of the pull-out member and holding a removable member which is removed from the image forming apparatus body, the holding member being movable between an insertion enabling position and a removing position; and a pull-out regulating member provided on a downstream end of the holding member in the pull-out direction and regulating a movement of the removable member to a downstream side in the pull-out direction.

18 Claims, 28 Drawing Sheets

Kk4
Kk2
Kk3
Kk1
Kk2a
12
12a
7
8
9
Kk3
Kk2
Kk4
Kk2a
Kk1
12
12a
7
8
9
1
1a
81
88
82
83
76c
71
72
Kk6
76
63d
63
63c
62b
Kk7
KHk
Kk
Kk1
22
6
2
2a
2d
12
64a
2b
61
64
31
19
RTk
17
18
16
21
21a
21b
21c
23
24
Z
Y
X
(−X)
(−Y)
(−Z)

Z
(-Y)
X
(-Z)
Y
(-X)
Kk
Kk1
Kk4
RTk
1
1a
4
17a
17b
17c
18
19
23
22a
22b
27b
16a
27a
22c
27
27c
22
36d
33
26
48
31
66
47
21
21a
21b
21c
24
18b
18c
18a
16

REMOVABLE MEMBER-HOLDING DEVICE AND IMAGE FORMING APPARATUS

CROSS-REFERENCE TO RELATED APPLICATION

This application is based on and claims priority under 35 USC §119 from Japanese Patent Application No. 2009-044616 filed Feb. 26, 2009 and Japanese Patent Application Nos. 2009-068904, 2009-068919 and 2009-068938 filed Mar. 19, 2009.

BACKGROUND (i) Technical Field

The present invention relates to a removable member-holding device and an image forming apparatus. In particular, the invention relates to a device for holding a removable member such as a cartridge.

(ii) Related Art

In an image forming apparatus such as a copying machine or a printer, a consumed article can be exchanged as a removable member in order to exchange the consumed article.

The removable member indicates an object which is constituted removably from an apparatus body. For example, a plurality of functional components functioning in the image forming apparatus is changed into a unit integrally and removably and is thus constituted as in a photosensitive unit in which a photosensitive member, a charging device and a cleaning member can be integrally removed from the apparatus body in some cases or the functional component such as a toner cartridge can be removed singly in the other cases.

SUMMARY

According to an aspect of the invention, there is provided a removable member-holding device comprising:

a pull-out member being movably between an accommodating position in which the pull-out member is accommodated in an image forming apparatus body and a pull-out position in which the pull-out member is pulled out of the image forming apparatus body outward from the accommodating position along a pull-out direction thereof;

a holding member supported on the pull-out member and having a holding member body, the holding member being extended in a moving direction of the pull-out member and holding a removable member which is removed from the image forming apparatus body, the holding member being movable between an insertion enabling position in which the pull-out member can be moved from the pull-out position toward the accommodating position and a removing position in which at least a downstream side of the holding member in the pull-out direction is moved downward in a direction of a gravity with respect to the insertion enabling position so that the removable member can be removed; and a pull-out regulating member provided on a downstream end of the holding member in the pull-out direction and regulating a movement of the removable member to a downstream side in the pull-out direction.

BRIEF DESCRIPTION OF THE DRAWINGS

Exemplary embodiments of the present invention will be described in detail based on the following figures, wherein.

DETAILED DESCRIPTION

Figure 1:
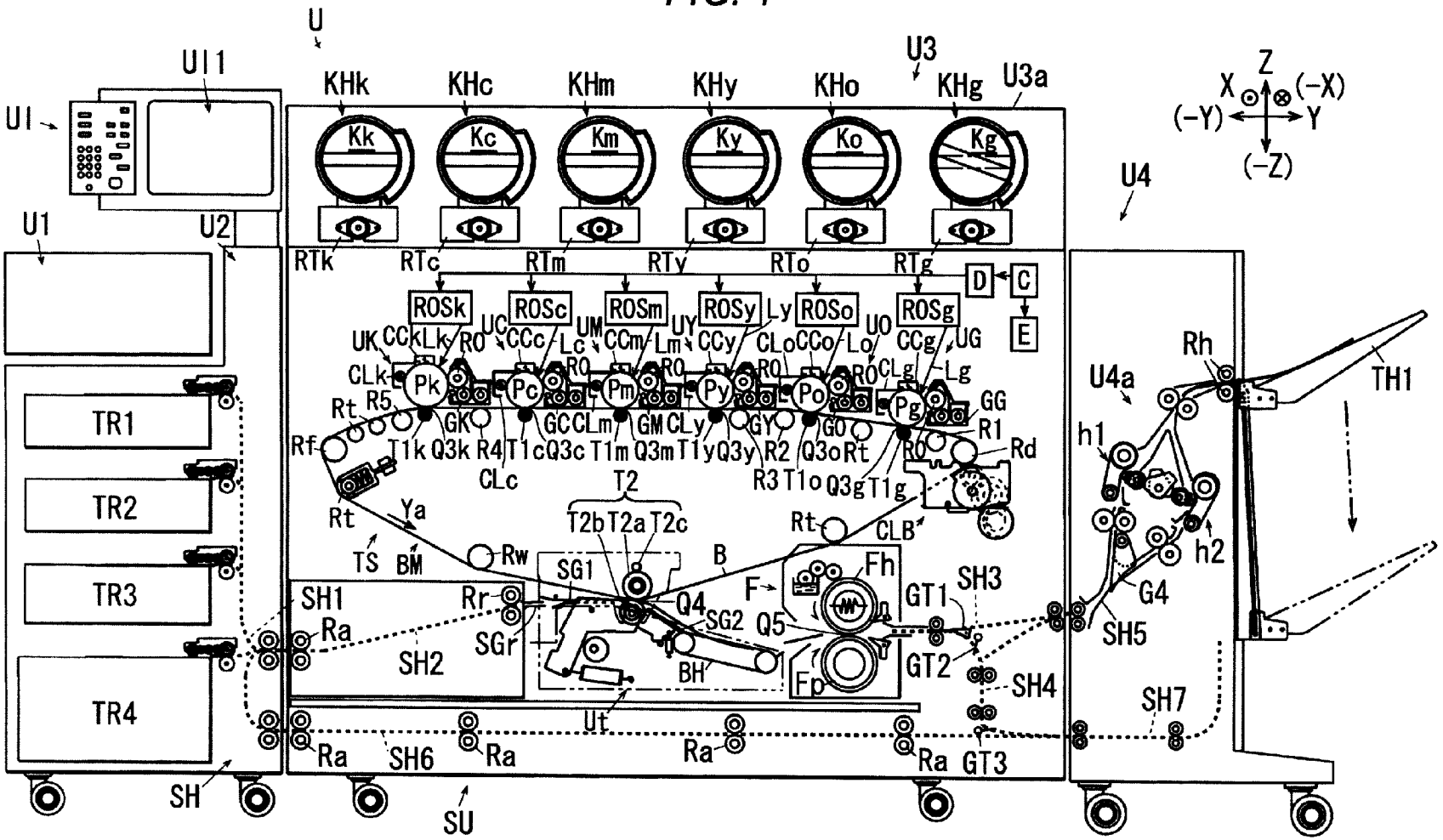
FIG. 1 is a general explanatory view showing an image forming apparatus according to a first exemplary embodiment of the invention.

Next, exemplary embodiments (hereinafter referred to as embodiments) according to the invention will be described with reference to the drawings, and the invention is not restricted to the following embodiments.

In order to easily understand the following description, in the drawings, a longitudinal direction is set to be an X-axis direction, a transverse direction is set to be a Y-axis direction, a vertical direction is set to be a Z-axis direction, and directions or sides shown in arrows X, −X, Y, −Y, Z and −Z are set to be forward, rearward, rightward, leftward, upward and downward directions or front, rear, right, left, upper and lower sides, respectively.

Moreover, "●" described in a circle indicates an arrow from a back side toward a right side of a paper, and "x" described in a circle indicates an arrow from the right side toward the back side of the paper.

In the following explanation using the drawings, members other than necessary members for the explanation will be properly omitted for easy understanding.

First Embodiment

FIG. 1 is a general explanatory view showing an image forming apparatus according to a first exemplary embodiment of the invention.

In FIG. 1, an image forming apparatus U in accordance with the first embodiment has a user interface UI as an embodiment of an apparatus operating portion, an image inputting device U1 as an embodiment of an image information inputting device, a paper feeding device U2, an image forming apparatus body U3, and a paper processing device U4.

The user interface UI has an inputting button such as a copy start key as an embodiment of an image forming start button, a copy sheet number setting key as an embodiment of an image forming sheet number setting button, and a ten key as an embodiment of a numeral inputting button, and a display device UI1.

The image inputting device U1 is constituted by an image scanner as an embodiment of an automatic document feeding device and an image reading device. In FIG. 1, the image inputting device U1 reads a document which is not shown and converts the document into image information, and inputs the image information to the image forming apparatus body U3.

Paper supplying trays TR1 to TR4 as an embodiment of paper supplying portions are movably supported on the paper feeding device U2. A recording paper S as an embodiment of a final transferring member and a medium is accommodated in each of the paper supplying trays TR1 to TR4, and the recording paper S is fed from each of the paper supplying trays TR1 to TR4 and is thus fed to the image forming apparatus body U3 through a paper feeding path SH1.

In FIG. 1, the image forming apparatus body U3 has an image recording portion for recording an image on the recording paper S fed from the paper feeding device U2, a toner dispenser device U3*a* as an embodiment of a developer supplying device, a paper feeding path SH2, a paper discharging path SH3, a paper inverting path SH4, and a paper circulating path SH6.

Moreover, the image forming apparatus body U3 has a controlling portion C, a laser driving circuit D as an embodiment of a latent image writing device driving circuit which is to be controlled by the controlling portion C, and a power circuit E to be controlled by the controlling portion C. The laser driving circuit D outputs laser driving signals corresponding to image information about G: green, O: orange, Y: yellow, M: magenta, C: cyan and K: black which are input from the image inputting device U1 to latent image forming devices ROSg, ROSo, ROSy, ROSm, ROSc and ROSk for the respective colors at a preset time, that is, in a preset timing.

Image holding member units UG, UO, UY, UM, UC and UK and developing devices GG, GO, GY, GM, GC and GK for the respective colors as an embodiment of the developing device are removably attached below the latent image forming devices ROSg to ROSk for the respective colors.

The image holding member unit UK for a black color has a photosensitive drum Pk as an embodiment of an image holding member, a charging device CCk, and a cleaner CLk as an embodiment of a cleaning device for the image holding member. Moreover, a developing roll R0 as an embodiment of a developing member of the developing device GK for the black color is disposed adjacently to a right side of the photosensitive drum Pk. The image holding member units UG to UC for the other colors also have photosensitive drums Pg, Po, Py, Pm and Pc, charging devices CCg, CCo, CCy, CCm and CCc, and cleaners CLg, CLo, CLy, CLm and CLc. Furthermore, a developing roll R0 as an embodiment of developing members of the developing devices GG to GC for the respective colors is disposed adjacently to a right side of the photosensitive drums Pg to Pc.

In the first embodiment, the photosensitive drum Pk for a K color which has a high using frequency and has a surface worn greatly is constituted to have a larger diameter than the photosensitive drums Pg to Pc for the other colors, and copes with a high speed rotation and has a lifetime prolonged.

Visible image forming members (UG+GG), (UO+GO), (UY+GY), (UM+GM), (UC+GC) and (UK+GK) are constituted by the image holding member units UY to UO and the developing devices GY to GO.

In FIG. 1, the photosensitive drums Pg to Pk are charged by the charging devices CCg to CCk respectively and electrostatic latent images are then formed on surfaces by laser beams Lg, Lo, Ly, Lm, Lc and Lk as examples of latent image writing lights output from the latent image forming devices ROSg to ROSk. Electrostatic latent images on the surfaces of the photosensitive drums Pg to Pk are developed into toner images as examples of images having the respective colors of G: green, O: orange, Y: yellow, M: magenta, C: cyan and K: black, that is, visible images by the developing devices GG to GK.

The toner images on the surfaces of the photosensitive drums Pg to Pk are sequentially superposed onto an intermediate transferring belt B as an embodiment of an intermediate transferring member and are thus transferred by means of primary transferring rolls T1*g*, T1*o*, T1*y*, T1*m*, T1*c* and T1*k* as an embodiment of primary transferring members in primary transferring regions Q3*g*, Q3*o*, Q3*y*, Q3*m*, Q3*c* and Q3*k* so that a multicolor image, that is, a so-called color image is formed on the intermediate transferring belt B. The color image formed on the intermediate transferring belt B is transported to a secondary transferring region Q4.

In case of only black image data, only the photosensitive drum Pk and developing device GK for the black color is used, and only a black toner image is formed. In the case in which four-color printing for Y, M, C and K or two-color or three-color printing corresponding to a setting operation of a user is carried out, moreover, the pertinent photosensitive drums Pg to Pk and developing devices GG to GK are used.

After the primary transfer, a toner remaining on each of the surfaces of the photosensitive drums Pg to Pk is cleaned away by means of each of the cleaners CLg to CLk for the photosensitive drum, and is recharged by the charging devices CCg to CCk.

Depending on a consumption of a developer in each of the developing devices GG to GK, the developer is transported and supplied from toner cartridges Kg, Ko, Ky, Km, Kc and Kk as an embodiment of a removable member attached to the toner dispenser device U3*a*, that is, an embodiment of a developer housing container.

Figure 2:
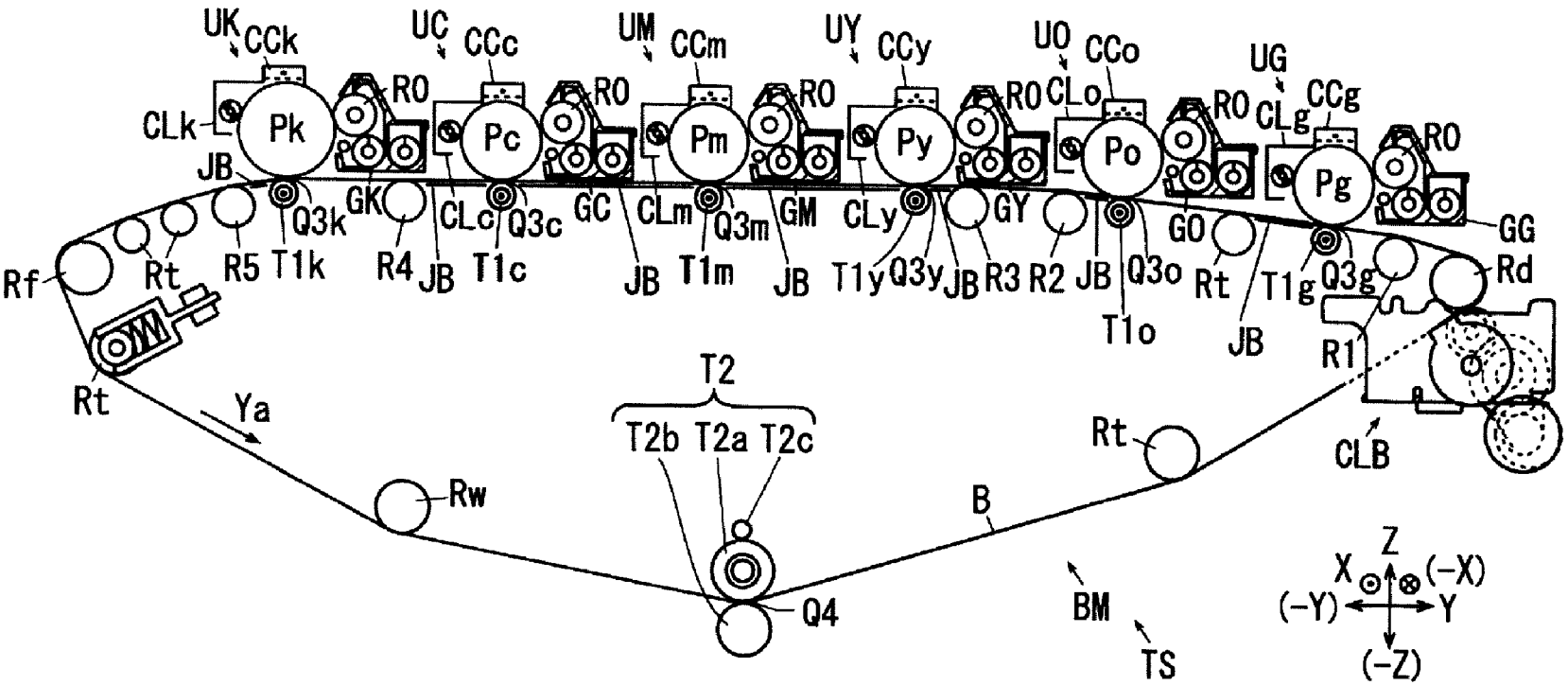
FIG. 2 is a general explanatory view showing a belt module according to the first exemplary embodiment of the invention.

FIG. 2 is a general explanatory view showing a belt module according to the first embodiment of the invention.

In FIGS. 1 and 2, a belt module BM as an embodiment of an intermediate transferring device is supported to enable upward and downward movements between an upward moving position in which it comes in contact with lower surfaces of the photosensitive drums Pg to Pk and a downward moving position in which it separates from the lower surfaces in a downward direction below the photosensitive drums Pg to Pk.

The belt module BM has the intermediate transferring belt B. The intermediate transferring belt B is rotated and driven in a direction of an arrow Ya by means of a belt driving roll Rd as an embodiment an intermediate transferring member driving member for supporting the intermediate transferring belt B from a back side, and a tension is applied by a tension roll Rt as an embodiment of a tension applying member so that the intermediate transferring belt B is stretched. Moreover, the intermediate transferring belt B has a back side supported by a walking roll Rw as an embodiment of a meander preventing member for preventing a meander of the intermediate transferring belt B, a plurality of idler rolls Rf as an embodiment of a driven member and a backup roll T2*a* as an embodiment of a secondary transfer opposing member.

In the first embodiment, moreover, a first retract roll R1 as an embodiment of an approaching and separating intermediate transferring member supporting member is disposed on an upstream side in a direction of an arrow Ya in the primary transferring roll T1*g* for the G color. The first retract roll R1 is supported movably in approaching and separating directions which are perpendicular to the direction of the arrow Ya and in which the intermediate transferring belt B is caused to approach and separate from the photosensitive drum Pg. Moreover, a second retract roll R2 and a third retract roll R3 as an embodiment of the approaching and separating intermediate transferring member supporting member which are constituted in the same manner as the first retract roll R1 are arranged and disposed on a downstream side in the direction of the arrow Ya of the primary transferring roll T1*y* for the O color and the upstream side in the direction of the arrow Ya of the primary transferring roll T1*y* for the Y color. Furthermore, a fourth retract roll R4 as an embodiment of the approaching and separating intermediate transferring member supporting member which is constituted in the same manner as the first retract roll R1 is disposed on the downstream side in the direction of the arrow Ya in the primary transferring roll T1*c* for the C color and the upstream side in the direction of the arrow Ya in the primary transferring roll T1*k* for the K color. Furthermore, a fifth retract roll R5 as an embodiment of the approaching and separating intermediate transferring member supporting member which is constituted in the same manner as the first retract roll R1 is disposed on the downstream side in the direction of the arrow Ya in the primary transferring roll T1*k* for the K color.

Moreover, an antistatic plate JB taking a shape of a flat plate as an embodiment of an antistatic member for removing an electric charge on a back face of the intermediate transferring belt B is disposed on the downstream side in the direction of the arrow Ya in each of the primary transferring rolls T1*g* to T1*k*. The antistatic plate JB according to the first embodiment is disposed in non-contact with the intermediate transferring roll B and can be provided in a position placed apart by 2 mm from the back face of the intermediate transferring roll B.

The belt supporting rolls Rd, Rt, Rw, Rf, T2*a* and R1 to R5 as an embodiment of the intermediate transferring member supporting member for rotatably supporting the intermediate transferring belt B from a back side are constituted by the respective rolls Rd, Rt, Rw, Rf, T2*a* and R1 to R5.

Moreover, the belt module BM according to the first embodiment is constituted by the intermediate transferring belt B, the belt supporting rolls Rd, Rt, Rw, Rf, T2*a* and R1 to R5, the primary transferring rolls T1*g* to T1*k*, and the antistatic plate JB.

Furthermore, a secondary transferring unit Ut is disposed below the backup roll T2*a*. A secondary transferring roll T2*b* as an embodiment of a secondary transferring member of the secondary transferring unit Ut is disposed to enable a separation from and contact with the backup roll T2*a* with the intermediate transferring belt B interposed therebetween, and the secondary transferring region Q4 is formed by a region in which the secondary transferring roll T2*b* comes in pressure contact with the intermediate transferring belt B. Moreover, a contact roll T2*c* as an embodiment of a voltage applying contact member abuts on the backup roll T2*a*, and a secondary transferring device T2 as an embodiment of a final transferring member is constituted by the rolls T2*a* to T2*c*.

A secondary transferring voltage having the same polarity as a charging polarity of a toner is applied to the contact roll T2*c* in a preset timing from a power circuit controlled by the controlling portion C.

The paper feeding path SH2 is disposed below the belt module BM. The recording paper S supplied from the paper feeding path SH1 of the paper feeding device U2 is fed to the paper feeding path SH2, and is fed to the secondary transferring region Q4 via a medium guiding member SGr and an untransferred medium guiding member SG1 at a time that a toner image is transported to the secondary transferring region Q4 by means of a resist roll Rr as an embodiment of a paper feeding time regulating member.

The medium guiding member SGr is fixed and supported on the image forming apparatus body U3 together with the resist roll Rr.

A toner image formed on the intermediate transferring belt B is transferred onto the recording paper S by means of the secondary transferring device T2 when passing through the secondary transferring region Q4. In case of a full color image, the toner images superposed and transferred primarily onto the surface of the intermediate transferring belt B are secondarily transferred in a lump onto the recording paper S.

The intermediate transferring belt B subjected to the secondary transfer is cleaned by a belt cleaner CLB as an embodiment of an intermediate transferring cleaning device. The secondary transferring roll T2*b* and the belt cleaner CLB are supported to enable a separation from and a contact with the intermediate transferring belt B.

There is constituted a transferring device TS for transferring images on surfaces of the photosensitive drums Py to Po onto the recording paper S by means of the belt module BM, the secondary transferring device T2 and the belt cleaner CLB.

The recording paper S having the toner image transferred secondarily thereto is transported to a fixing device F via a paper transporting belt BH as an embodiment of a transferred medium guiding member SG2 and an unfixed medium transporting member. The fixing device F has a heating roll Fh as an embodiment of a heating and fixing member and a pressure roll Fp as an embodiment of a pressurizing and fixing member, and a fixing region Q5 is formed by a region in which the heating roll Fh and the pressure roll Fp come in pressure contact with each other.

The toner image on the recording paper S is heated and fixed by the fixing device F when passing through the fixing region Q5. A transporting path switching member GT1 is provided on a downstream side of the fixing device F. The transporting path switching member GT1 selectively switches the recording paper S fed along the paper feeding path SH2 and heated and fixed in the fixing region Q5 into either the paper discharging path SH3 side or the paper inverting path SH4 side in the paper processing device U4. The recording paper S transported along the paper discharging path SH3 is transported to a paper transporting path SH5 of the paper processing device U4.

A curl correcting device U4*a* is disposed in the middle of the paper transporting path SH5, and a switching gate G4 as an embodiment of a transporting path switching member is disposed on the paper transporting path SH5. The switching gate G4 transports the recording paper S transported from the paper discharging path SH3 of the image forming apparatus body U3 to either a first curl correcting member h1 side or a second curl correcting member h2 side corresponding to a direction of a curve, that is, a curl. Referring to the recording paper S transported to the first curl correcting member h1 or the second curl correcting member h2, the curl is corrected in a passing operation. The recording paper S having the curl corrected is discharged from a discharging roll Rh as an embodiment of a discharging member to a output tray TH1 as an embodiment of a discharging part of the paper processing device U4 in a state in which an image fixing surface of the paper is turned upward, that is, a face-up state.

The recording paper S transporting to the paper inverting path SH4 side of the image forming apparatus body U3 by the transporting path switching member GT1 passes to push away a transporting direction controlling member constituted by an elastic thin film-shaped member, that is, a Mylar gate GT2, and is then transported to the paper inverting path SH4 of the image forming apparatus body U3.

The paper circulating path SH6 and a paper inverting path SH7 are connected to a downstream end of the paper inverting path SH4 in the image forming apparatus body U3, and a Mylar gate GT3 is also disposed in a connecting part thereof. The recording paper S transported to the paper inverting path SH4 via the switching gate GT1 passes through the Mylar gate GT3 and is thus transported to the paper inverting path SH7 side of the paper processing device U4. In case of an execution of a duplex printing operation, when the recording paper S transported along the paper inverting path SH4 once passes through the Mylar gate GT3 in that condition and is transported to the paper inverting path SH7, and is then transported in a reverse direction, that is, is switched back, the transporting direction is controlled by means of the Mylar gate GT3 and the recording paper S thus switched back is transported to the paper circulating path SH6 side. The recording paper S transported to the paper circulating path SH6 is retransmitted to the transferring region Q4 via the paper feeding path SH1.

On the other hand, when the recording paper S transported along the paper inverting path SH4 is switched back after a rear end of the recording paper S passes through the Mylar gate GT2 and before it passes through the Mylar gate GT3, the transporting direction of the recording paper S is controlled by the Mylar gate GT2 and the recording paper S is transported to the paper transporting path SH5 in a state in which both sides are inverted. The curl of the recording paper S having the both sides inverted is corrected by means of the curl correcting member U4*a* and can be then discharged to the paper discharging tray TH1 of the paper processing device U4 in a state in which the image fixing surface of the recording paper S is turned downward, that is, a face-down state.

The paper transporting (or feeding) path SH is constituted by the elements indicated as the designations of SH1 to SH7. Moreover, a paper transporting device SU is constituted by the elements indicated as the designations of SH, Ra, Rr, Rh, SGr, SG1, SG2, BH and GT1 to GT3.

(Toner Dispenser Device U3*a*)

In FIG. 1, the toner dispenser device U3*a* according to the first embodiment has cartridge holders KHg, KHo, KHy, KHm, KHc and KHk to which the toner cartridges Kg to Kk for the respective colors of G, O, Y, M, C and K are attached, and reserve tanks RTg, RTo, RTy, RTm, RTc and RTk as an embodiment of a developer reservoir container in which developers supplied from the respective cartridges Kg to Kk are temporary stored and stirred, and the developer stirred in the reserve tanks RTg to RTk is transported by means of a transporting member (not shown) corresponding to an amount of consumption of the developer in the developing devices GG to GK.

Next, description will be given to the cartridge holders KHg to KHk as an embodiment of a removable member-holding device in accordance with the first embodiment. Since each of the cartridge holders KHg to KHk has the same structure, description will be given to the cartridge holder KHk for the K color and detailed description of the cartridge holders KHg to KHc for the other colors will be omitted.

Figures 3A, 3B, 3C:
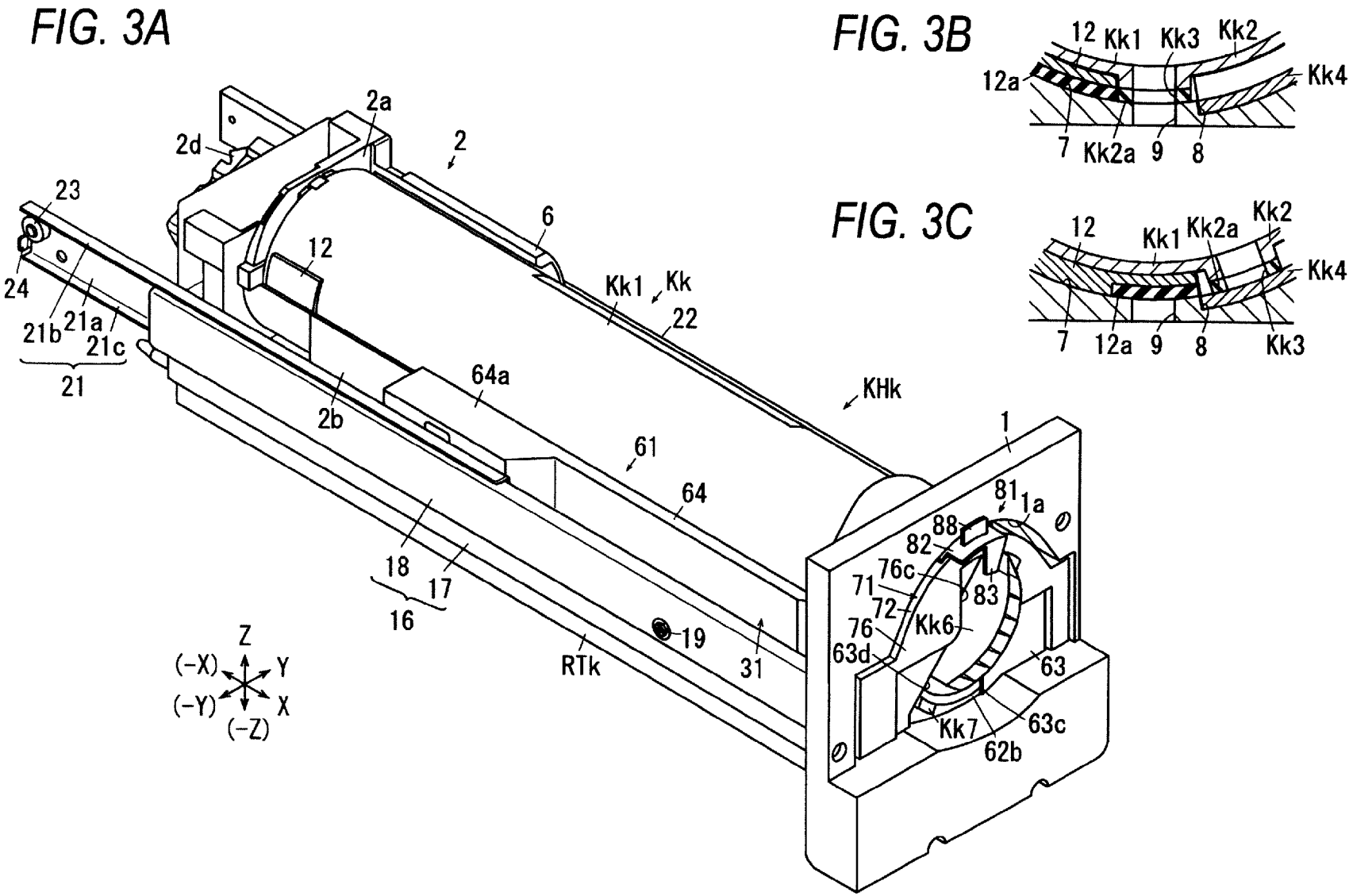
FIGS. 3A to 3C are perspective views showing a main part of a toner dispenser device according to the first exemplary embodiment of the invention, FIG. 3A being a perspective view showing a state of a movement to an accommodating position in which the toner dispenser device is accommodated in the image forming apparatus, FIG. 3B being an explanatory view showing a state in which an outlet of a toner cartridge and an inlet of the toner dispenser device are connected to each other, and FIG. 3C being an explanatory view showing a state in which a toner cartridge is rotated in the state of FIG. 3B.

FIGS. 3A to 3C are perspective views showing a main part of a toner dispenser device according to the first embodiment, FIG. 3A being a perspective view showing a state of a movement to an accommodating position in which the toner dispenser device is accommodated in the image forming apparatus, FIG. 3B being an explanatory view showing a state in which an outlet of a toner cartridge and an inlet of the toner dispenser device are connected to each other, and FIG. 3C being an explanatory view showing a state in which a toner cartridge is rotated in the state of FIG. 3B.

Figure 4:
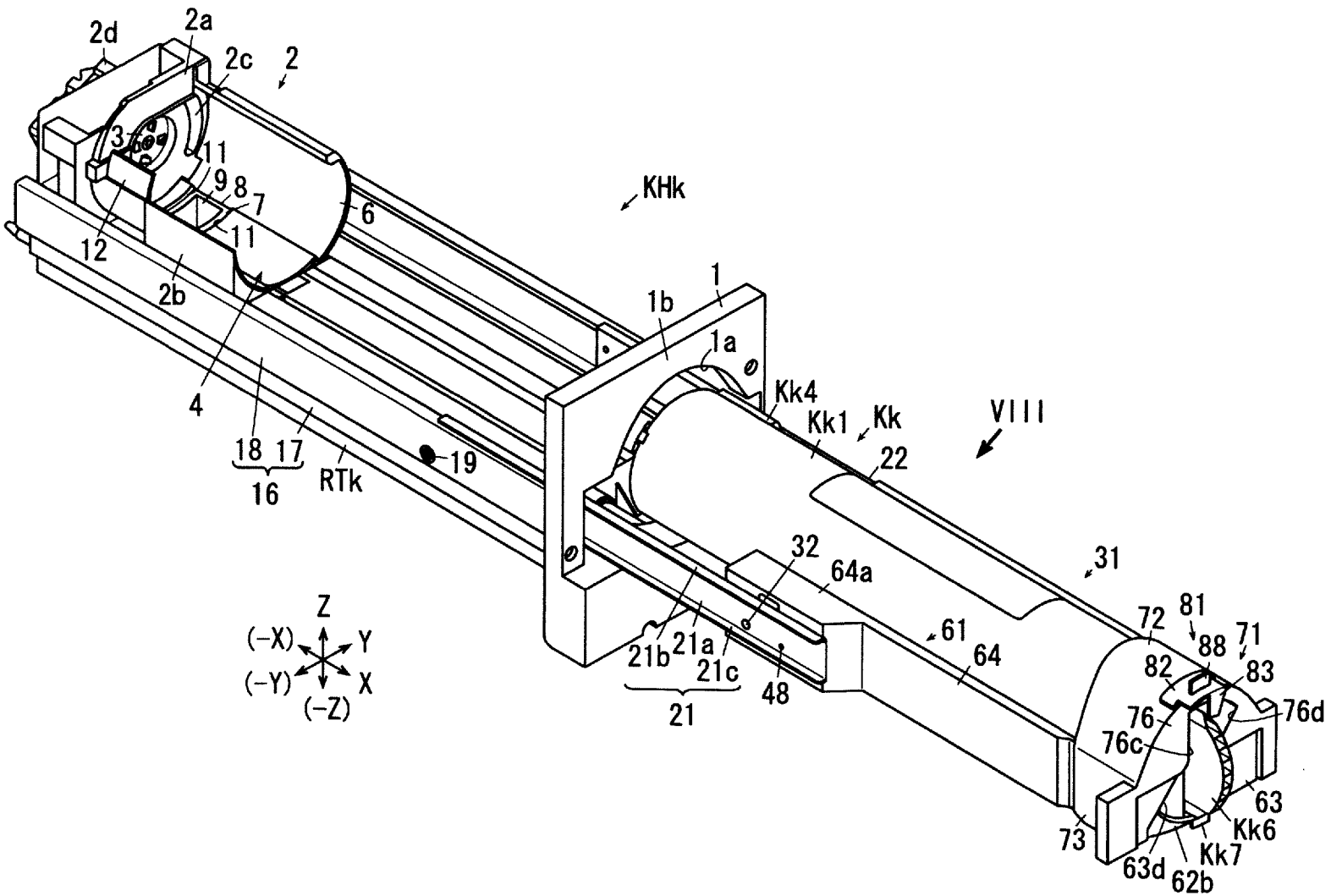
FIG. 4 is a perspective view showing the main part of the toner dispenser device according to the first exemplary embodiment of the invention, illustrating a state of a movement to a pull-out position in which a tilting holder is pulled out in the state of FIGS. 3A to 3C.

FIG. 4 is a perspective view showing the main part of the toner dispenser device according to the first embodiment, illustrating a state of a movement to a pull-out position in which a tilting holder is pulled out in the state of FIGS. 3A to 3C.

Figure 5:
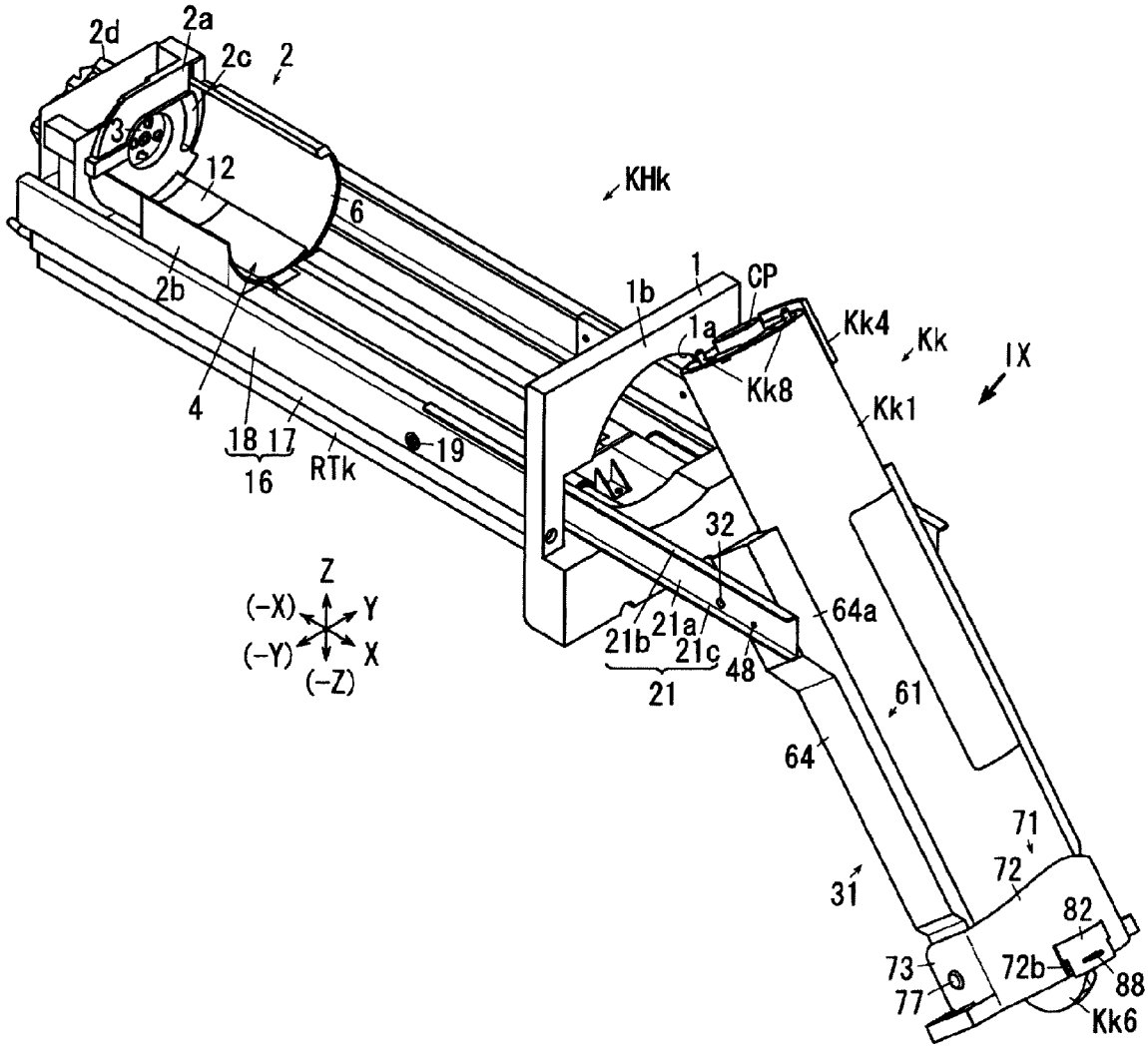
FIG. 5 is a perspective view showing the main part of the toner dispenser device according to the first exemplary embodiment of the invention, illustrating a state in which the tilting holder is moved to a tilting position in the state of FIG. 4.

FIG. 5 is a perspective view showing the main part of the toner dispenser device according to the first embodiment, illustrating a state in which the tilting holder is moved to a tilting position in the state of FIG. 4.

Figure 6:
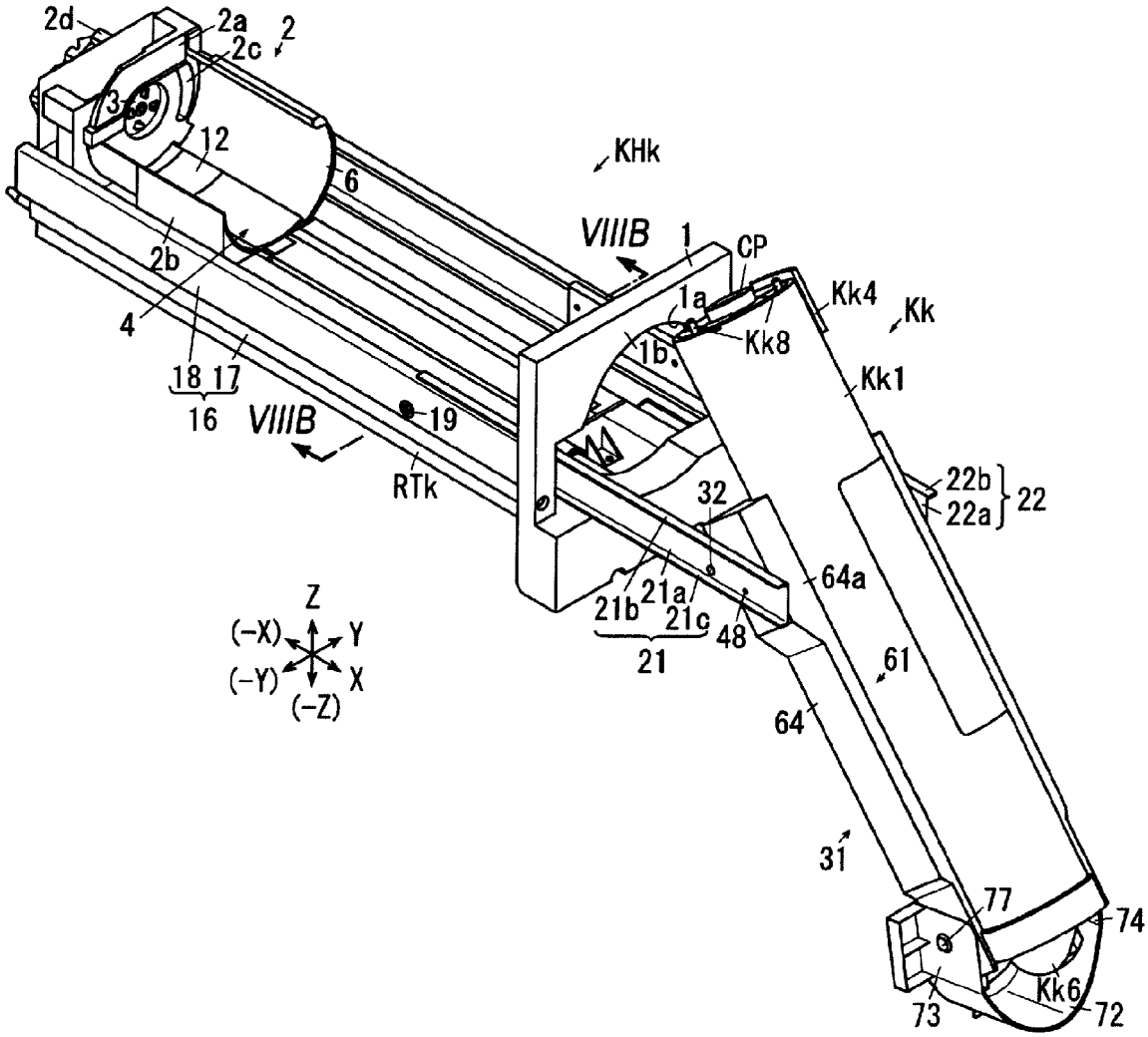
FIG. 6 is a perspective view showing the main part of the toner dispenser device according to the first exemplary embodiment of the invention, illustrating a state in which a front end cover is moved to a front end opening position in the state of FIG. 5.

FIG. 6 is a perspective view showing the main part of the toner dispenser device according to the first embodiment, illustrating a state in which a front end cover is moved to a front end opening position in the state of FIG. 5.

Figure 7:
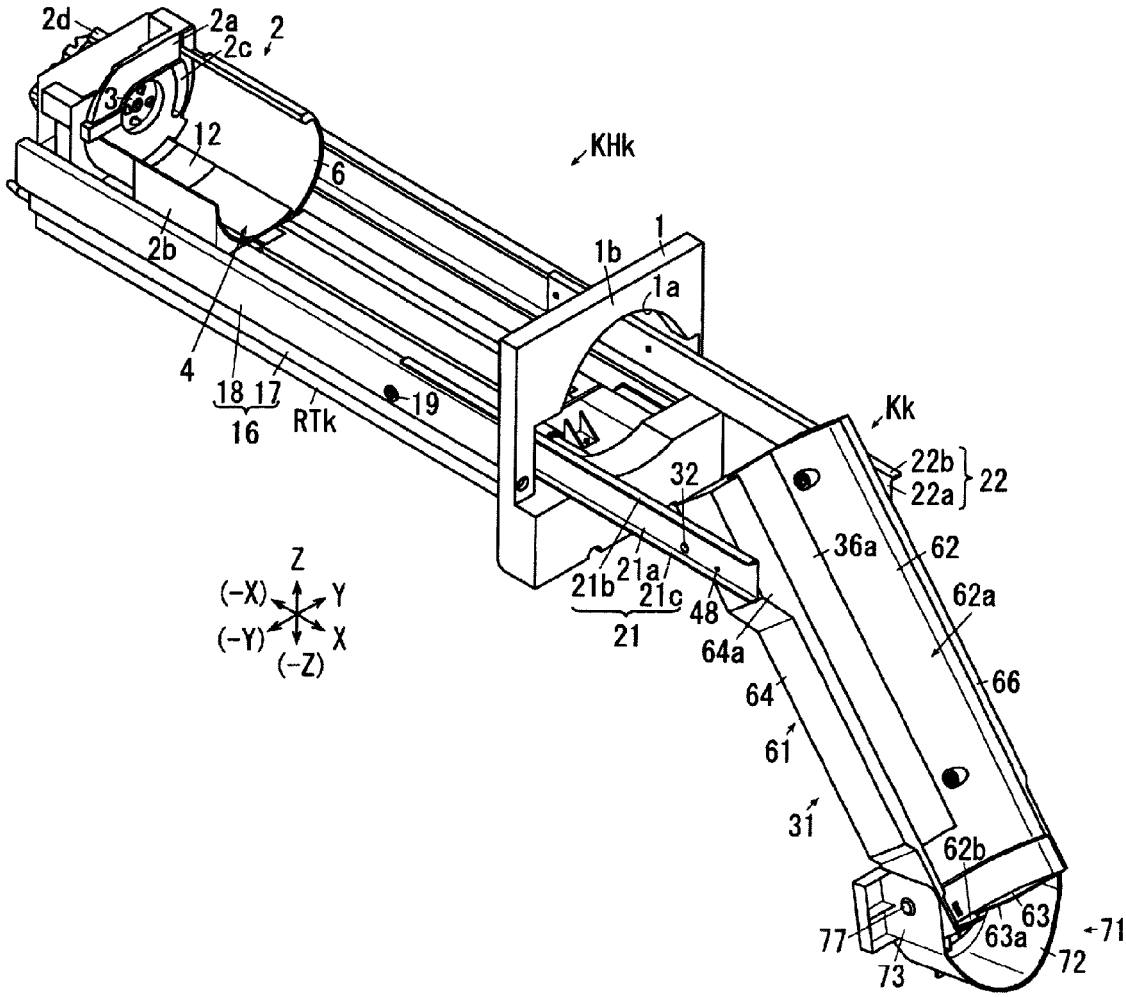
FIG. 7 is a perspective view showing the main part of the toner dispenser device according to the first exemplary embodiment of the invention, illustrating a state in which the toner cartridge is pulled out in the state of FIG. 6.

FIG. 7 is a perspective view showing the main part of the toner dispenser device according to the first embodiment, illustrating a state in which the toner cartridge is taken out in the state of FIG. 6.

In FIG. 4, a shutter on a body side is moved to an outlet closing position. For easy understanding, however, there is shown a state in which the shutter is moved to an outlet opening position.

In FIGS. 1 and 3 to 7, the cartridge holder KHk for the K color has a front side frame 1 as an embodiment of a front end frame member fixed and supported on the image forming apparatus body U3, and a holder base 2 as an embodiment of a fixing member which is disposed on a rear end of the reserve tank RTk. In FIGS. 3 to 7, an opening 1*a* taking a shape of a circular hole is formed on the front side frame 1. The toner cartridge Kk to be attached and removed passes through the opening 1*a*. In FIGS. 4 to 7, the holder base 2 has a rear end wall 2*a* taking a shape of a plate and disposed on the rear end, and a cylinder wall 2*b* taking a shape of a semicylinder and extended forward from the rear end wall 2*a*.

A hard key attaching groove 2*c* constituted by a groove taking a shape of a circular arc as an embodiment of an erroneous attachment preventing portion on the body side is formed on the rear end wall 2*a*, and a hard key Kk8 as an embodiment of an erroneous attachment preventing portion on a movable body side can be fitted in the hard key attaching groove 2*c*. The hard key Kk8 is protruded rearward from a rear end of the toner cartridge Kk. Accordingly, presetting is carried out in such a manner that positions of the hard key attaching groove 2*c* and the hard key Kk 8 are coincident with each other and they are thus fitted in and the positions are shifted from each other and they are not fitted in if the colors are not coincident with each other in the case in which there are attached the toner cartridges Kg to Kk accommodating the developers corresponding to the colors of the developing devices Gg to Gk.

Moreover, a coupling 3 as an embodiment of a drive transmitting member to which a driving operation is transmitted from a driving source 2*d* is supported on the rear end wall 2*a*. The coupling 3 is engaged with a coupling CP shown in FIG. 5 as an embodiment of a driven transmitting member provided on a rear end of the toner cartridge Kk which is attached, and thus transmits a rotation to a developer transporting member (not shown) in the toner cartridge Kk.

The cylinder wall 2*b* of the holder base 2 has an inner peripheral surface 4 taking an arcuate shape and extended leftward from a bottom part, and a shutter passing groove 6 as an embodiment of an opening and closing member passage which is formed in a right part of the inner peripheral surface 4 and is formed to take a concave shape from the inner peripheral surface 4, and is extended in a longitudinal direction. Moreover, a rear end of the inner peripheral surface 4 is provided with an inlet forming portion 7 which is concaved from the inner peripheral surface 4 taking the arcuate shape and is formed to take a convex shape from the shutter passing groove 6, and is extended in a circumferential direction of the cylinder wall 2*b*, and a shutter pressing portion 8 as an embodiment of the opening and closing member pressing portion is formed by a step portion of a boundary between the inlet forming portion 7 and the shutter passing groove 6.

The inlet forming portion 7 is provided with an inlet 9 to be connected to the reserve tank RTk in a lower part. Both front and rear sides of the inlet 9 are provided with a body side shutter guide 11 as an embodiment of a shielding member guiding portion formed to take a shape of a circular arc along the inner peripheral surface 4 of the cylinder wall 2*b*, and a body side shutter 12 taking a shape of a circular arc along the inner peripheral surface 4 of the cylinder wall 2*b* is supported on the body side shutter guide 11 movably in a circumferential direction. The body side shutter 12 is energized in such a direction as to close the outlet 9 by means of a spring which is not shown, and is supported movably between an inlet opening position shown in FIG. 3B in which the inlet 9 is opened and an inlet closing position shown in FIG. 3C in which the inlet 9 is closed. In FIGS. 3B and 3C, moreover, a body seal 12*a* as an embodiment of a leakage preventing member is supported on the inlet 9 side of the body side shutter 12.

In FIGS. 3 and 4, the toner cartridge Kk attached to the holder base 2 according to the first embodiment has a cylindrical container body Kk1. In FIGS. 3B and 3C, an outlet portion Kk2 protruded outward in a radial direction of the container body Kk1 is formed on a rear end of the container body Kk1. An outlet Kk3 from which a developer in the container body Kk1 flows out is formed in the outlet portion Kk2, and a cartridge seal Kk2*a* as an embodiment of a leakage preventing member is supported on an outer end of the outlet Kk2 to surround the outlet Kk3. Moreover, a cartridge shutter Kk4 as an embodiment of an opening and closing member which is movable in a circumferential direction of the container body Kk1 is attached to the outlet portion Kk2. A depth of a concave part of the shutter passing groove 6 in the holder base 2 is set in such a manner that the cartridge shutter Kk4 with the outlet Kk3 closed can pass therethrough. Moreover, a depth of the concave part of the inlet forming portion 7 is smaller than a thickness of the cartridge shutter Kk4 and is greater than an amount of protrusion from the container body Kk1 in the outlet portion Kk2.

As shown in the outlet closing position in FIGS. 3C, 5 to 7, accordingly, when the toner cartridge Kk1 is inserted, the cartridge shutter Kk4 can be attached to the rear end via the shutter passing groove 6. In the case in which a position of the cartridge shutter Kk4 of the toner cartridge Kk is inserted in a rotating position which does not correspond to the shutter passing groove 6, it cannot be inserted to the rear end due to an interferes with a front end face of the holder base 2.

When a user rotates a cartridge handle Kk6 as an embodiment of an operating portion which is provided on a front end of the toner cartridge Kk in a state in which the toner cartridge Kk is attached to the rear end, then, the cartridge shutter Kk4 is caught on a shutter pressing portion 8 and is not rotated, and the container body Kk1 and the outlet portion Kk2 are rotated, and furthermore, the body side shutter 12 is pressed by the outlet portion Kk2 and is thus moved. Consequently, the outlet Kk3 is opened, and furthermore, the inlet 9 is also opened, and the inlet Kk3 and the inlet 9 are connected to each other so that the developer can be supplied as shown in the outlet opening position of FIG. 3B.

A front end of the toner cartridge Kk according to the first embodiment is provided with a push-in rib Kk7 as an embodiment of a push-in transmitting portion protruded in the radial direction of the container body Kk1.

Figures 8A, 8B:
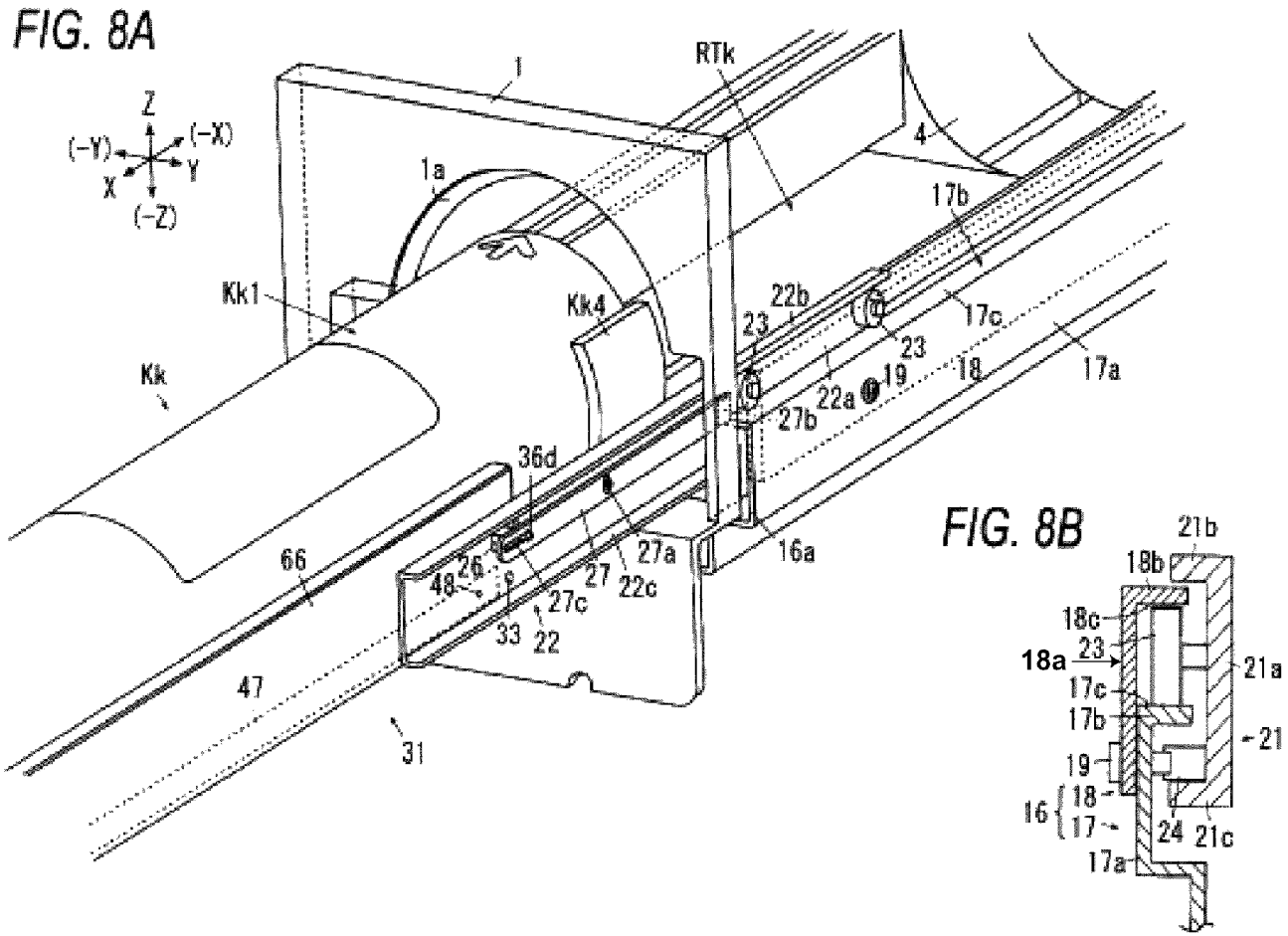
FIGS. 8A and 8B are explanatory views showing the main part of a pull-out member portion according to the first embodiment, FIG. 8A being an explanatory view showing a main part seen in a direction of an arrow VIII in FIG. 4, and FIG. 8B being a sectional view taken along a VIIIB-VIIIB line in FIG. 6.

FIGS. 8A and 8B are explanatory views showing a main part of a pull-out member portion according to the first embodiment, and FIG. 8A is an explanatory view showing a main part seen in a direction of an arrow VIII in FIG. 4 and FIG. 8B is a sectional view taken along a VIIIB-VIIIB line in FIG. 6.

Figure 9:
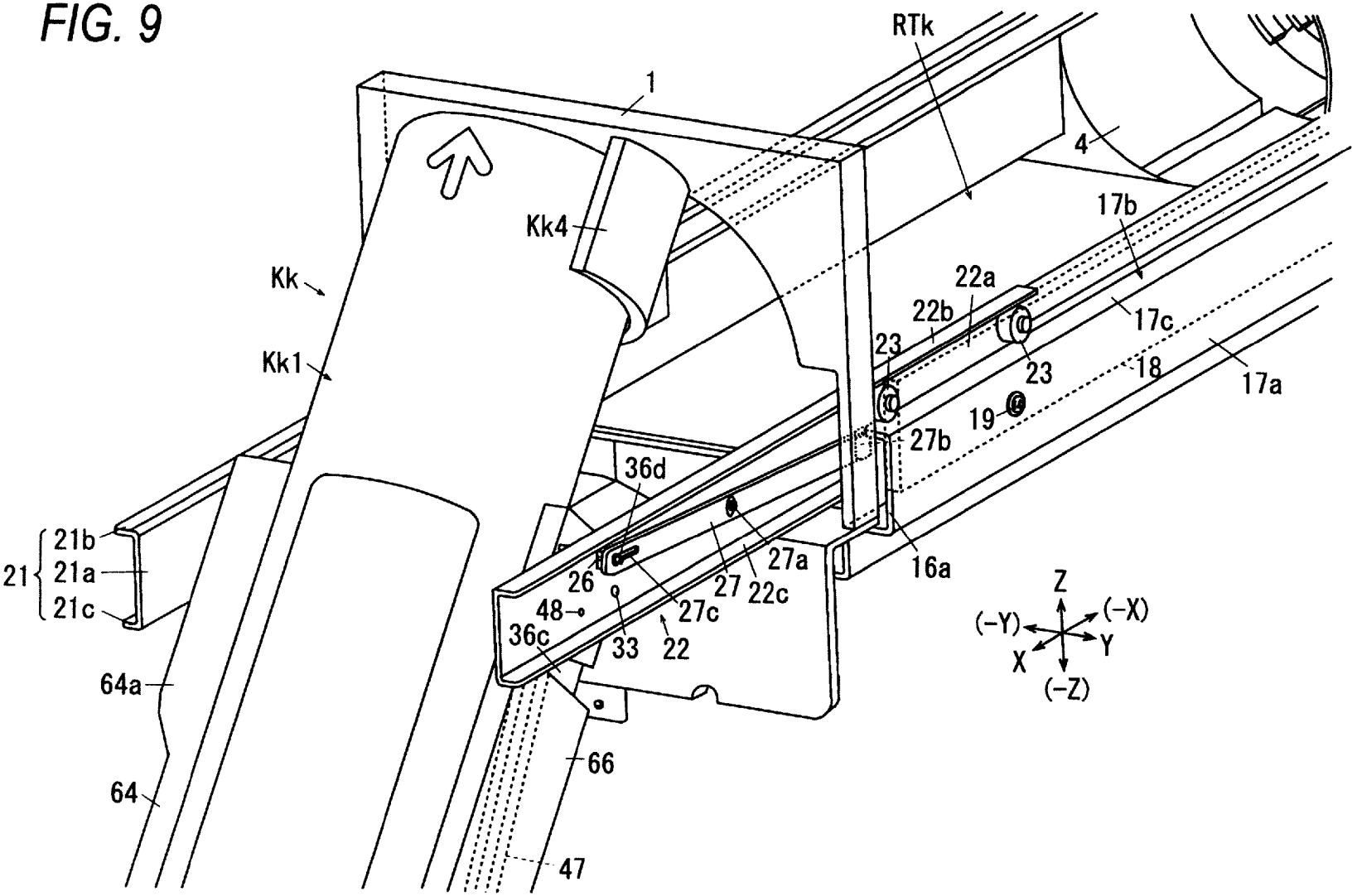
FIG. 9 is an explanatory view showing a main part seen in a direction of an arrow IX in FIG. 5.

FIG. 9 is an explanatory view showing a main part seen in a direction of an arrow IX in FIG. 5.

In FIGS. 8A, 8B and 9 and the succeeding drawings, for explanation and easy understanding of the apparatus, members disposed in an inner part which cannot be seen from an outside are displayed in a solid line and members disposed on an outside are shown in a broken line or a chain line or are not shown.

In FIGS. 3 to 7, a pair of left and right guide rails 16 extended in a longitudinal direction as an embodiment of a pull-out guiding member is fixed and supported on both of left and right sides of the holder base 2. In FIGS. 8A and 9, the guide rail 16 has a rail body 17 as an embodiment of a guiding member body disposed on a lower side in a direction of a gravity. The rail body 17 has a sidewall portion 17*a* extended in a vertical direction and a lower guiding portion 17*b* formed to take an inward bending shape from an upper end of the sidewall portion 17*a*. A lower roller guiding surface 17*c* is formed on an upper surface of the lower guiding portion 17*b*. An upper guide rail 18 as an embodiment of an upper guiding member extended upward is fixed and supported on an outer side surface of the rail body 17 with a screw 19. The upper guide rail 18 has an outer cover portion 18*a* as an embodiment of a closing portion extended upward, and an upper guiding portion 18*b* taking an inward bending shape from an upper end of the outer cover portion 18*a*. An upper roller guiding surface 18*c* is formed on a lower surface of the upper guiding portion 18*b*.

A pair of left and right guided rails 21 and 22 as an embodiment of a pull-out member are supported on inner sides of the pair of left and right guide rails 16 movably in a longitudinal direction. In FIGS. 3, 8A and 9, the guided rails 21 and 22 have pull-out member bodies 21*a* and 22*a* extended in a vertical direction, and upper guided portions 21*b* and 22*b* and lower guided portions 21*c* and 22*c* which are formed to take an outward bending shape from both upper and lower ends of the pull-out member bodies 21*a* and 22*a*. The upper guided portions 21*b* and 22*b* have lower surfaces disposed opposite to an upper surface of the upper guiding portion 18*b*, and the guided rails 21 and 22 are supported movably in a forward direction to be a pull-out direction and a rearward direction to be a push-in direction.

A roller 23 as an embodiment of the pair of front and rear guided members is rotatably supported on rear parts of the pull-out member bodies 21*a* and 22*a*, and is interposed between the lower roller guiding surface 17*c* and the upper roller guiding surface 18*c* in the guide rail 16 and is disposed in this state. When the guided rails 21 and 22 are to be moved, accordingly, the roller 23 is rotated over the roller guiding surfaces 17*c* and 18*c*. As compared with the case in which the roller 23 is not provided, therefore, a movement can be carried out smoothly in a longitudinal direction with a lower frictional resistance and smaller force.

In FIGS. 3A to 3C, a stopper 24 as an embodiment of a pull-out stopped portion which is protruded toward the sidewall portion 17*a* side of the guide rail 16 on an outside is formed in rear parts of the pull-out member bodies 21*a* and 22*a*. In FIGS. 3A to 3C, in respect of the drawings, only the stopper 24 of the guided rail 21 on the left side is shown. In FIG. 8B, the stopper 24 is disposed to enable a contact with and separation from an inner end of the screw 19 as an embodiment of the pull-out stopping portion which fixes the rail body 17 to the upper guide rail 18 and penetrates therethrough. When the guided rails 21 and 22 are pulled out in a forward direction to the pull-out position shown in FIG. 4, accordingly, the stopper 24 and the screw 19 come in contact with each other so that a more forward movement of the guided rails 21 and 22 is controlled. Therefore, the guided rails 21 and 22 according to the first embodiment are supported movably between the accommodating position shown in FIGS. 3A to 3C and the pull-out position shown in FIG. 4.

In FIGS. 8 and 9, a through hole 26 penetrating in a transverse direction is formed on a front end of the pull-out member body 22*a* of the guided rail 22 on the right side.

A link 27 as an embodiment of an interlocking member extended in the longitudinal direction is supported on the guided rail 22 at the right side rotatably around a link rotating center 27*a* along an outer side surface provided behind the through hole 26. A rear end of the link 27 is provided with a stopped portion 27*b* which can come in contact with and separate from the erroneous insertion stopping portion 16*a* on a front end of the guide rail 16 at the right side and is bent to take a J shape. Accordingly, the link 27 is supported rotatably around the link rotating center 27*a* between a stopping portion separating position shown in FIGS. 8A and 8B in which the stopped portion 27*b* separates from the erroneous insertion stopping portion 16*a* so that the guided rail 22 can be moved between the accommodating position and the pull-out position and a stopping portion contact position shown in FIG. 9 in which the stopped portion 27*b* comes in contact with the erroneous insertion stopping portion 16*a* so that the guided rail 22 is controlled to be moved from the pull-out position to the accommodating position.

A front end of the link 27 has a coupling hole 27*c* taking a shape of a slot formed thereon. The coupling hole 27*c* is formed corresponding to the through hole 26 and is extended in the longitudinal direction.

Figure 10:
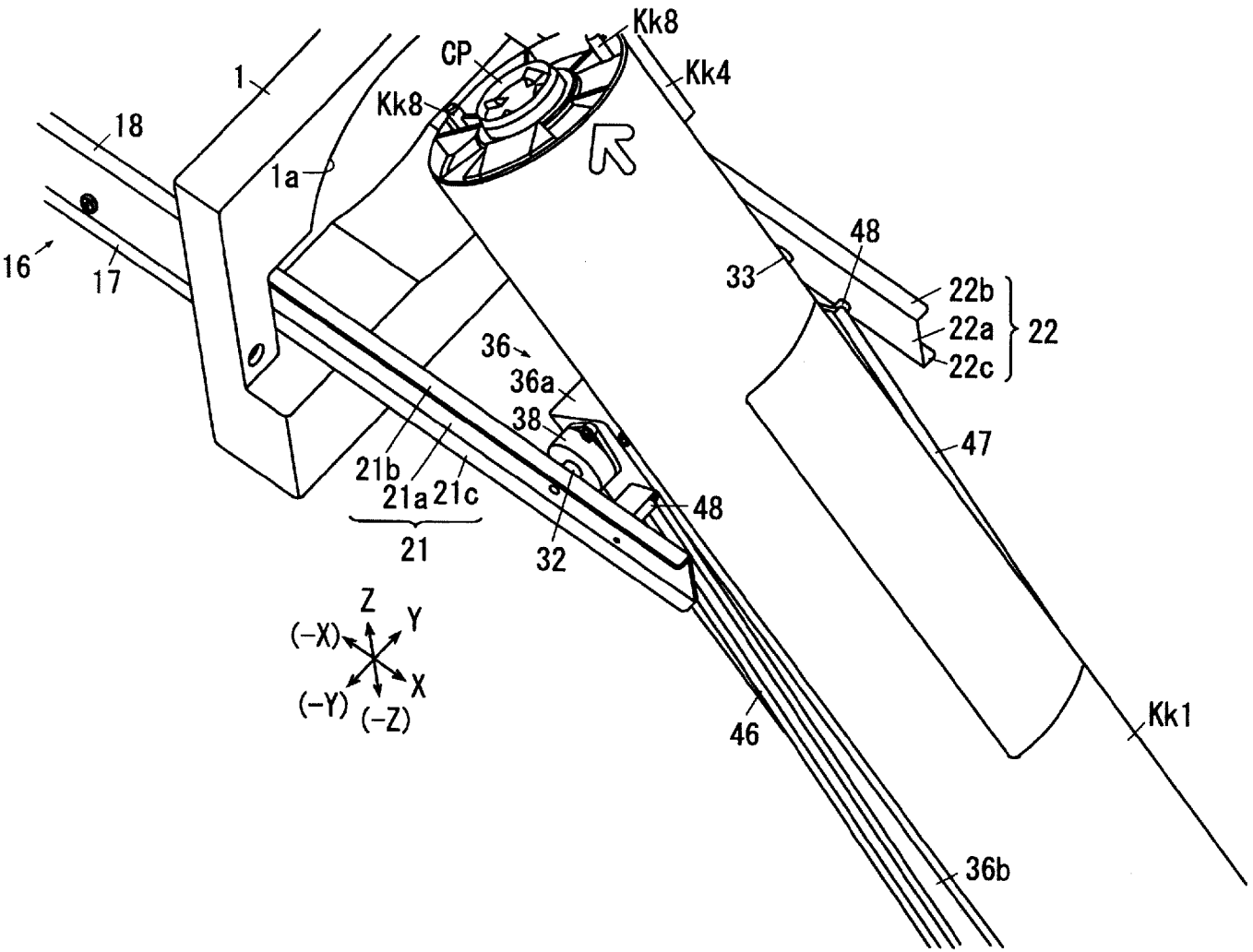
FIG. 10 is an explanatory view showing a braking member according to the first exemplary embodiment of the invention.

FIG. 10 is an explanatory view showing the braking member according to the first embodiment.

In FIG. 10, a holder cover is not shown for easy understanding of a holder frame.

In FIGS. 3 to 9, a tilting holder 31 as an embodiment of a holding member and an embodiment of a rotation holding member is supported on front ends of the guided rails 21 and 22 rotatably around holder rotating shafts 32 and 33. The tilting holder 31 has a holder frame 36 as an embodiment of a frame member. In FIG. 10, the holder frame 36 has a plate-shaped holder frame bottom wall 36*a* extended in an axial direction of the toner cartridge Kk, and a holder frame left sidewall 36*b* and a holder frame right sidewall 36*c* which are extended upward from both of left and right side ends of the holder frame bottom wall 36*a*. The holder rotating shafts 32 and 33 are coupled to rear ends of the holder frame left sidewall 36*b* and the holder frame right sidewall 36*c*.

In FIGS. 8 and 9, a link coupling pin 36*d* as an embodiment of a coupling member extended rightward is supported on the holder frame right sidewall 36*c* in a position placed rearward apart from the holder rotating shaft 33 on the right side. The link coupling pin 36*d* penetrates the through hole 26 of the guided rail 22 and is coupled to the coupling hole 27*c* of the link 27. The coupling hole 27*c* according to the first embodiment is formed to take a shape of a slot and the link coupling pin 36*d* is coupled in a state in which it can be moved along the coupling hole 27*c*. As shown in FIGS. 8 and 9, the link coupling pin 36*d* is disposed in a position placed in the vicinity of the holder rotating shaft 33 apart therefrom.

When the tilting holder 31 is rotated around the holder rotating shafts 32 and 33, accordingly, the link 27 coupled by means of the link coupling pin 36*d* is interlockingly rotated and moved between the stopping portion separating position shown in FIGS. 8A and 8B and the stopping position contact position shown in FIG. 9.

In FIG. 10, a one-way hinge 38 as an embodiment of the braking member and an embodiment of an overload protecting device is incorporated into the holder rotating shaft 32 on the left side. The one-way hinge 38 is a device put on the market and having a function of the overload protecting device for blocking a transmission of a rotating force which is equal to or greater than a preset rotating force when the same rotating force acts, a so-called torque limiter, and a function of a one-way rotation blocking device for transmitting only a rotation in one of the directions and carrying out idling with respect to a rotation in the other direction, a so-called one-way clutch. The one-way hinge 38 according to the first embodiment blocks a transmission of a rotating force which is equal to or greater than a preset rotating force when a rotating force acting in a specific rotating direction around the holder rotating shaft 32 is equal to or greater than the preset rotating force, and transmits a rotating force in a reverse direction to the specific rotating direction without blocking the transmission of the rotating force. More specifically, setting is carried out in such a manner that a transmission of a rotating force in a tilt rotating direction to be a rotating direction from an insertion enabling position shown in FIG. 4 toward a tilting position as an embodiment of a removing position shown in FIG. 5 is blocked and a moving speed for a rotating movement to the tilting position is thus controlled in the case in which the rotating force is equal to or greater than the preset rotating force, and a rotating force in a return rotating direction to be a rotating direction from the tilting position toward the insertion enabling position is transmitted. In the first embodiment, the preset rotating force is set to have a smaller value than a natural rotating force for acting by a gravity and rotating the tilting holder 31.

Figures 11A, 11B:
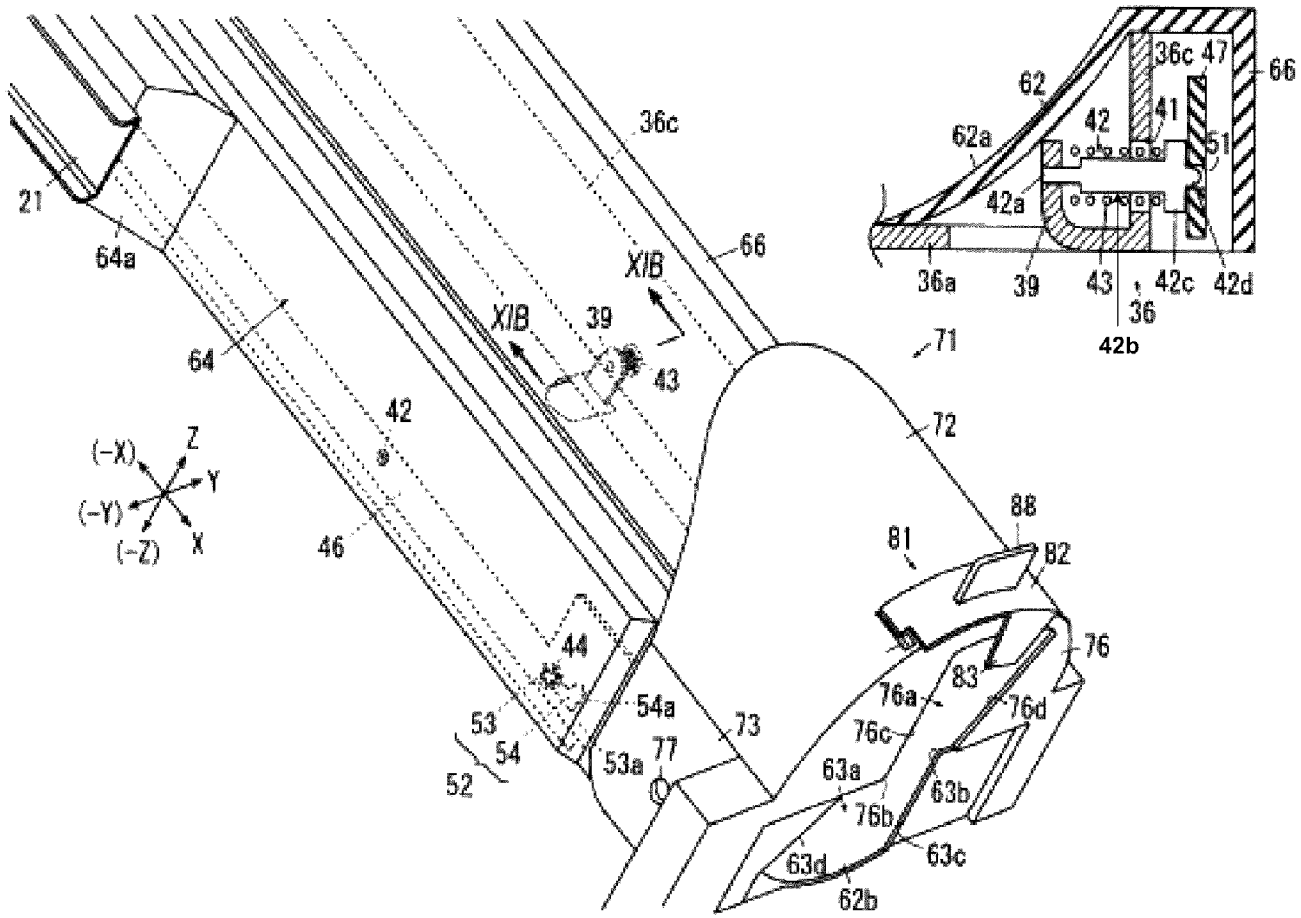
FIGS. 11A and 11B are explanatory views showing a main part of the tilting member according to the first exemplary embodiment of the invention, FIG. 11A being an explanatory view showing a main part of a front portion of the tilting holder in a state of a movement to an insertion enabling position in FIG. 4 and FIG. 11B being a sectional view taken along an XIB-XIB line in FIG. 11A.

FIG. 11 is an explanatory view showing a main part of the tilting holder according to the first embodiment, and FIG. 11A is an explanatory view showing a main part of a front portion of a tilting holder in a state in which it is moved to the insertion enabling state in FIG. 4 and FIG. 11B is a sectional view taken along an XIB-XIB line in FIG. 11A.

Figure 12:
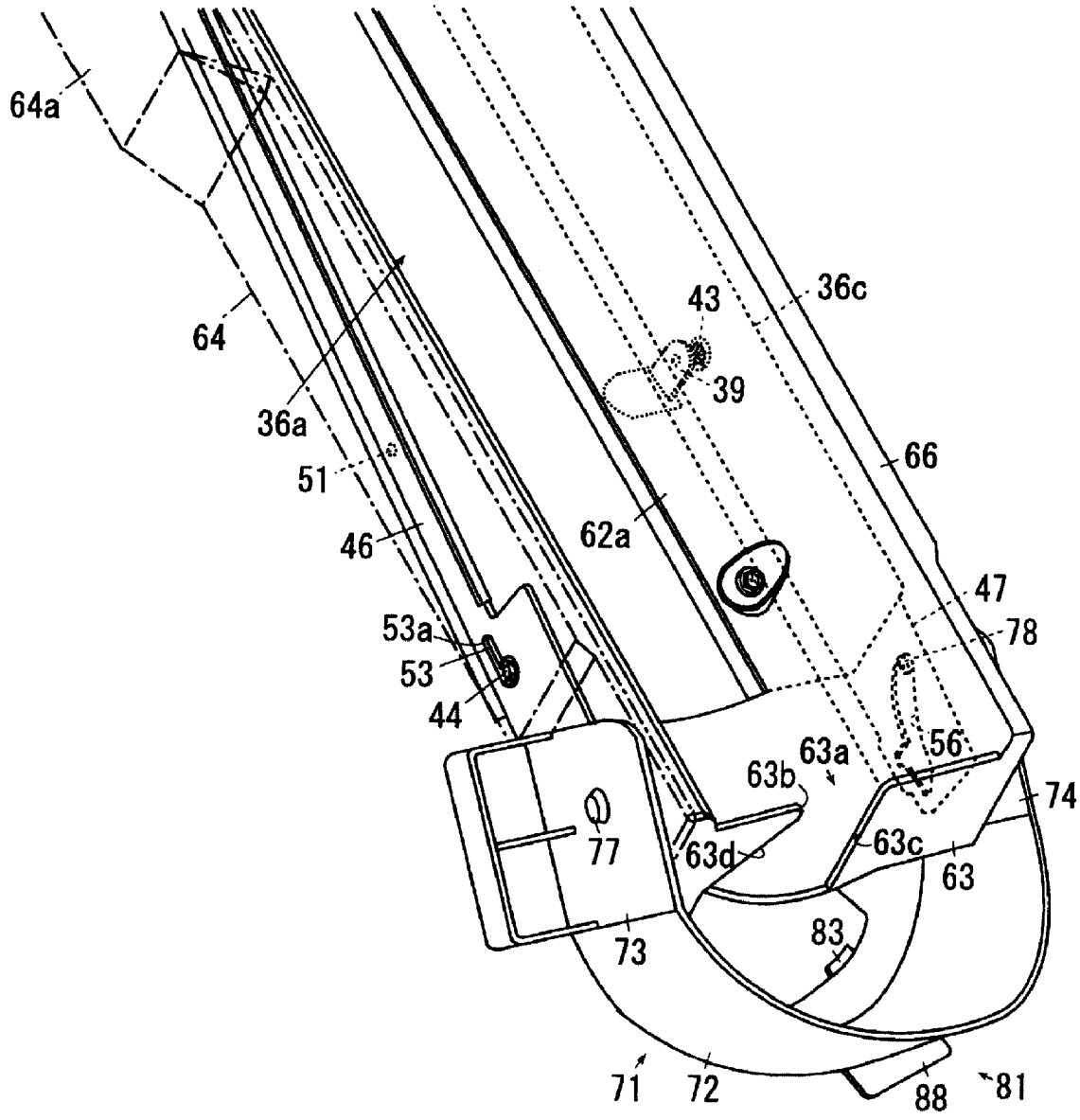
FIG. 12 is an explanatory view showing the main part of the tilting holder according to the first exemplary embodiment of the invention, illustrating the front part of the tilting holder moved to a tilting position in FIG. 7.

FIG. 12 is an explanatory view showing the main part of the tilting holder according to the first embodiment, illustrating the front portion of the tilting holder in a state in which it is moved to the tilting position in FIG. 7.

In FIGS. 11 and 12, a pair of left and right erected portions 39 which are erected are formed on the holder frame bottom wall 36*a* in a front part of the holder frame 36. In respect of the drawings, FIGS. 11 and 12 show only the erected portion 39 on a right side.

In FIGS. 11 and 12, a pin passing port 41 according to as embodiment of a hang passing port penetrating in a transverse direction is formed on the holder frame sidewalls 36*b* and 36*c* in an opposed position to the erected portion 39. A pin 42 as an embodiment of a hanging member which passes through the pin passing port 41 and is protruded outward from the holder frame sidewalls 36*b* and 36*c* is supported on the erected portion 39 movably in the transverse direction.

In FIG. 11B, the pin 42 has a supported portion 42*a* which is supported movably in the transverse direction in a state in which it penetrates through a support hole 39*a* of the erected portion 39. A pin body 42*b* penetrating through the pin passing port 41 and having a larger diameter than the supported portion 42*a* is formed integrally at an outside of the supported portion 42*a*. A disk-shaped spring supporting portion 42*c* having a larger diameter than the pin body 42*b* is formed integrally with an outer end of the pin body 42*b*. A projection-shaped hanging portion 42*d* protruded outward from the spring supporting portion 42*c* is formed on the spring supporting portion 42*c*.

In FIGS. 11 and 12, a pin energizing spring 43 as an embodiment of an energizing member for energizing the spring supporting portion 42*c* outward is attached between the erected portion 39 and the spring supporting portion 42*c*.

Moreover, a pair of left and right support coupling studs 44 extended outward from the holder frame sidewalls 36*b* and 36*c* is supported as an embodiment of a rotation regulating portion in a further forward part of the erected portions 39 of the holder frame sidewalls 36*b* and 36*c*.

Figure 13:
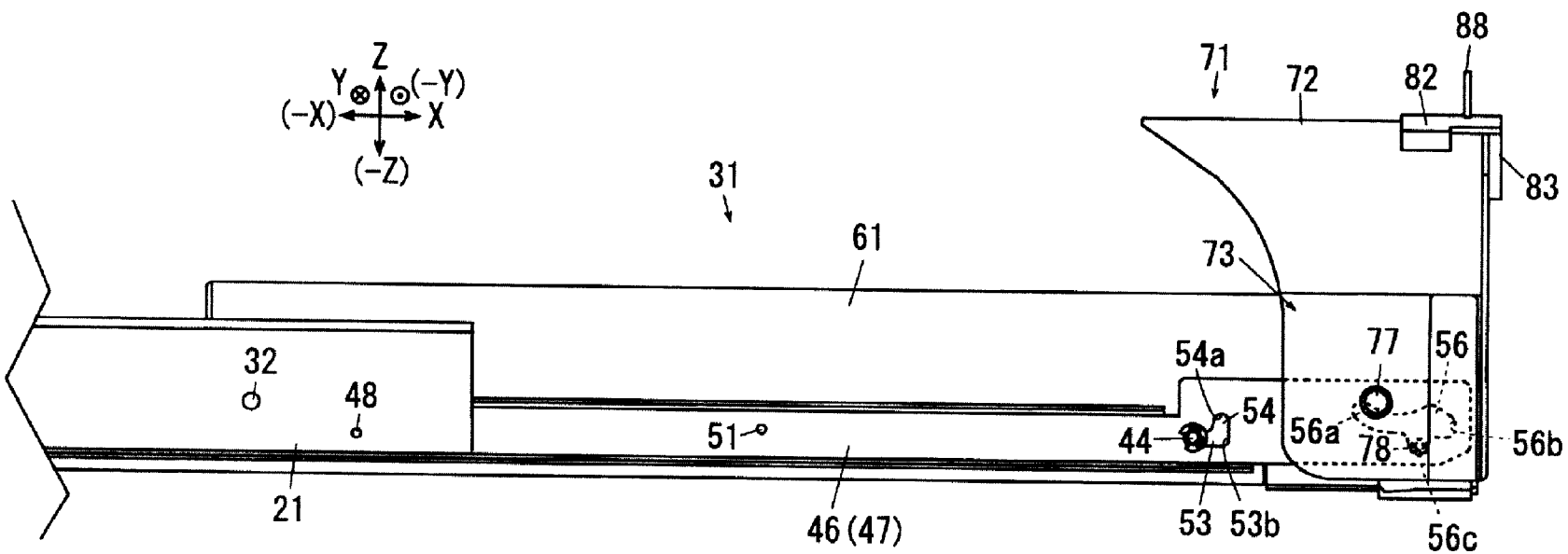
FIG. 13 is an explanatory view showing a main part of a support in a state in which a guided rail is moved to the pull-out position and the tilting holder is held in the insertion enabling position.

FIG. 13 is an explanatory view showing a main part of a support in a state in which the guided rail is moved to the pull-out position and the tilting holder is held in the insertion enabling position.

Figure 14:
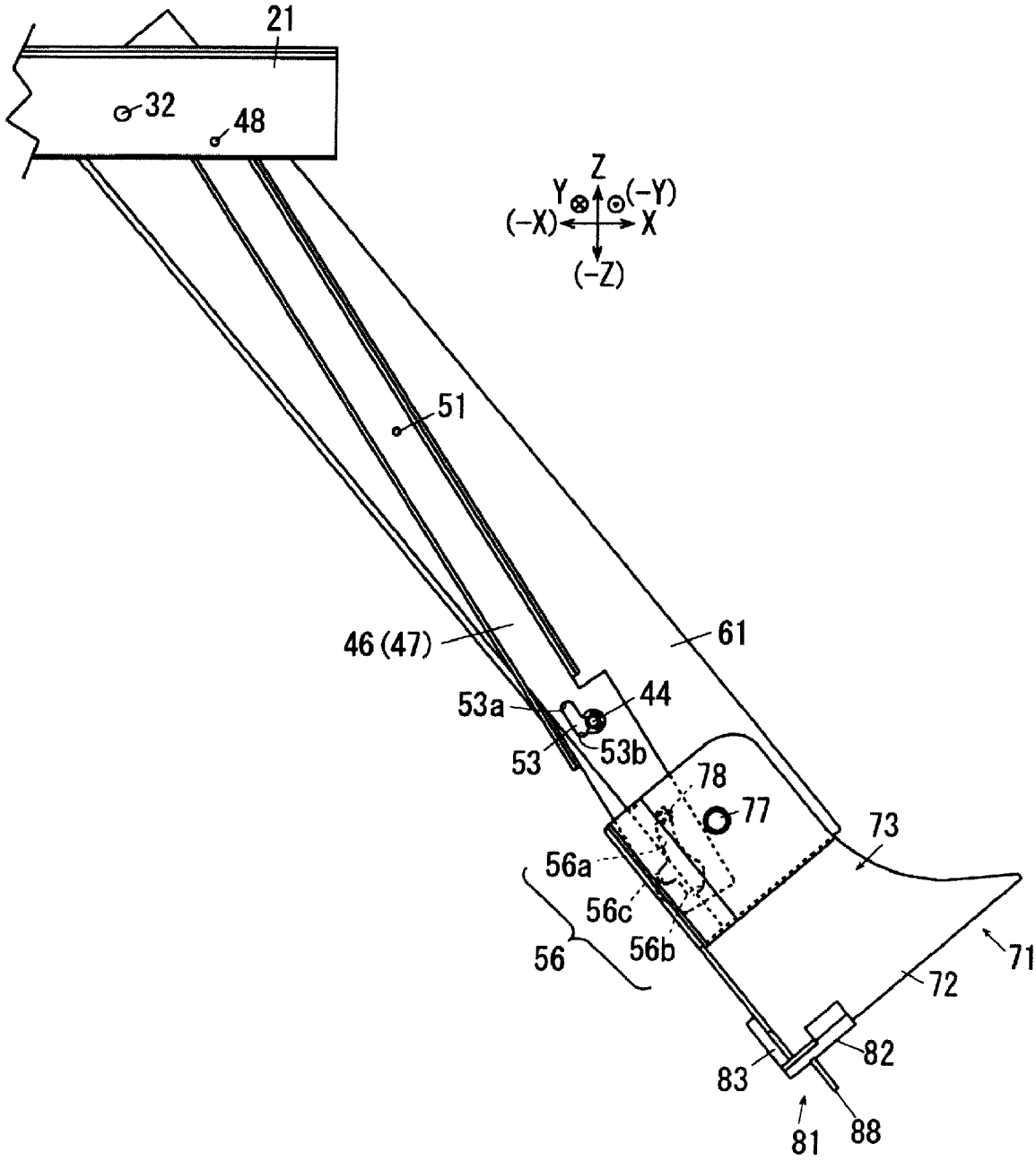
FIG. 14 is an explanatory view showing the main part of the support in a state in which the tilting holder is moved to the tilting position and a front end cover is moved to an opening position in the state illustrated in FIG. 13.

FIG. 14 is an explanatory view showing the main part of the support in a state in which the tilting holder is moved to the tilting position and the front end cover is moved to the opening position in the state illustrated in FIG. 13.

In FIGS. 8 to 14, a left support 46 and a right support 47 which take a shape of a plate extended in a longitudinal direction are disposed as an embodiment of an auxiliary rotor at an outside of the holder frame sidewalls 36*b* and 36*c* of the holder frame 36. Rear ends of the supports 46 and 47 are rotatably supported on the guided rails 21 and 22 by means of a support rotating shaft 48 as an embodiment of an auxiliary rotating shaft disposed in a position placed apart toward a front side of the holder rotating shafts 32 and 33. As shown in FIGS. 8 to 10, the support rotating shaft 48 according to the first embodiment is disposed in a position placed apart in the vicinity of the front side with respect to the holder rotating shafts 32 and 33, that is, close thereto.

In FIGS. 8 to 14, a latch hole 51 as an embodiment of a hung portion is formed corresponding to the hanging portion 42*d* in a state in which the tilting holder 31 is moved to the insertion enabling position shown in FIG. 13 in a central part in a longitudinal direction of each of the supports 46 and 47. More specifically, the latch hole 51 is held in a state in which the hanging portion 42*d* is hung on, that is, fitted in the latch hole 51 by an elastic force of the pin energizing spring 43 as shown in FIG. 11B in such a condition that the tilting holder 31 is moved to the insertion enabling position illustrated in FIG. 13. On the other hand, in the case in which the tilting holder 31 is moved to the tilting position shown in FIG. 14, the holder rotating shafts 32 and 33 of the holder frame 36 are shifted from the support rotating shaft 48 so that a shift occurs between the position of the hanging portion 42*d* and that of the latch hole 51. Therefore, the hanging portion 42*d* is moved inward against the elastic force of the pin energizing spring 43 and separates from the latch hole 51, that, is, slips off from the latch hole 51.

In FIGS. 11 to 14, a tilt stopping groove 52 is formed corresponding to the support coupling stud 44 in a front part of each of the supports 46 and 47. In FIGS. 11 and 13, the tilt stopping groove 52 has a guiding groove portion 53 extended along each of the supports 46 and 47, and a rotation regulating groove portion 54 extended upward from a front end of the guiding groove portion 53, and the support coupling stud 44 is formed by an almost L-shaped groove having such a width that the support coupling stud 44 can be moved along the groove. In FIGS. 11 to 14, a rear end of the guiding groove portion 53 is provided with an upper rotation locking surface 53*a* as an embodiment of an upper rotation regulating portion. The upper rotation locking surface 53*a* comes in contact with the support coupling stud 44 in the insertion enabling position shown in FIG. 13, thereby regulating a rotation of the tilting holder 31 in an upward direction from the insertion enabling position.

Moreover, a front end of the guiding groove portion 53 is provided with a lower rotation locking surface 53*b* as an embodiment of a lower rotation regulating portion. The lower rotation locking surface 53*b* comes in contact with the support coupling stud 44 in the tilting position shown in FIG. 14, thereby regulating a rotation of the tilting holder 31 in a downward direction from the tilting position. More specifically, a rotating position of the tilting holder 31 in which the support coupling stud 44 comes in contact with the lower rotation locking surface 53*b* is set to be the tilting position, and the tilting holder 31 is held in the tilting position by the contact of the support coupling stud 44 with the lower rotation locking surface 53*b*.

Furthermore, a rotation locking surface 54*a* according to an opening rotation regulating portion is constituted by an inner peripheral surface of the rotation regulating groove portion 54 in a position placed apart from the lower rotation locking surface 53*b* in an upward direction.

Figure 15:
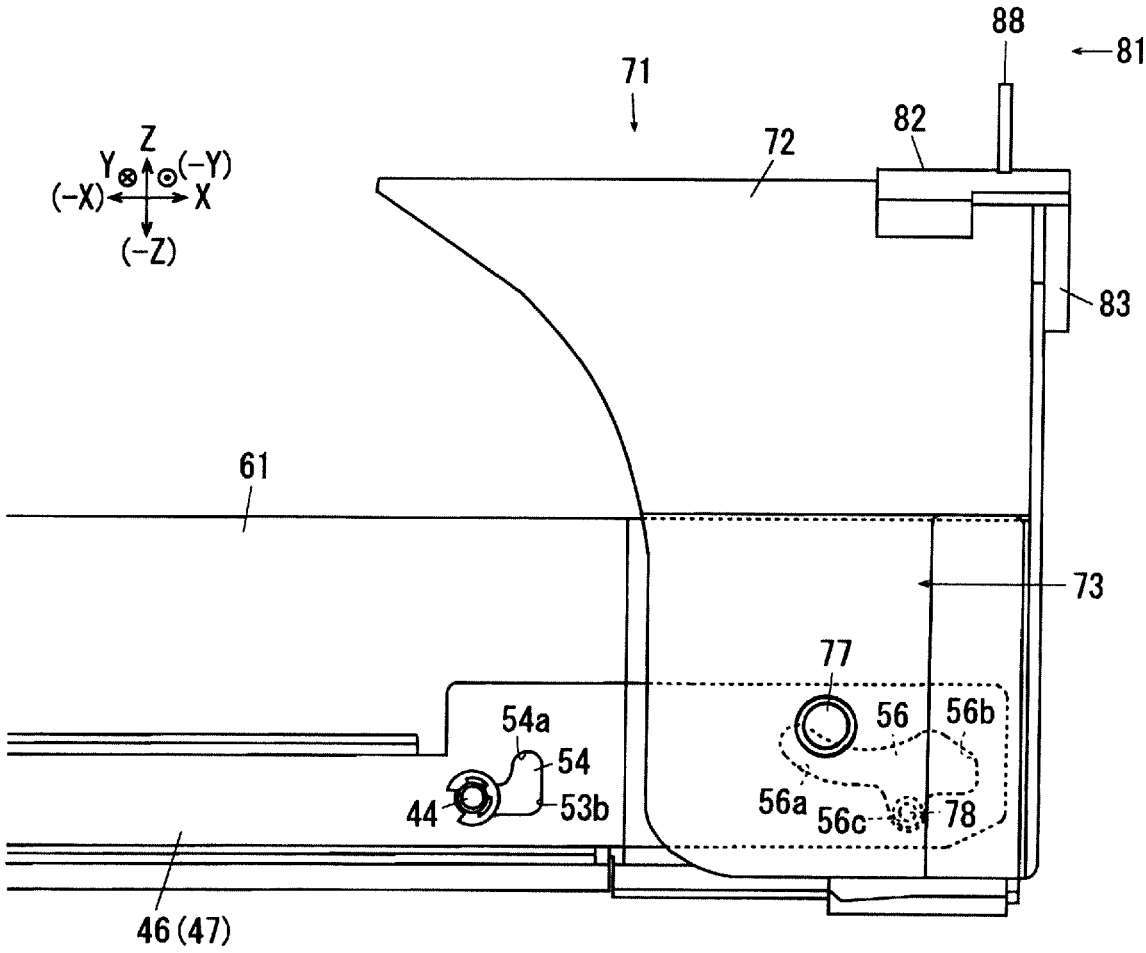
FIG. 15 is an explanatory view showing a main part of a front end of the tilting holder according to the first exemplary embodiment of the invention, illustrating a state in which the tilting holder is moved to the insertion enabling position.

FIG. 15 is an explanatory view showing a main part of the front end of the tilting holder according to the first embodiment, illustrating a state in which the tilting holder is moved to the insertion enabling position.

Figure 16:
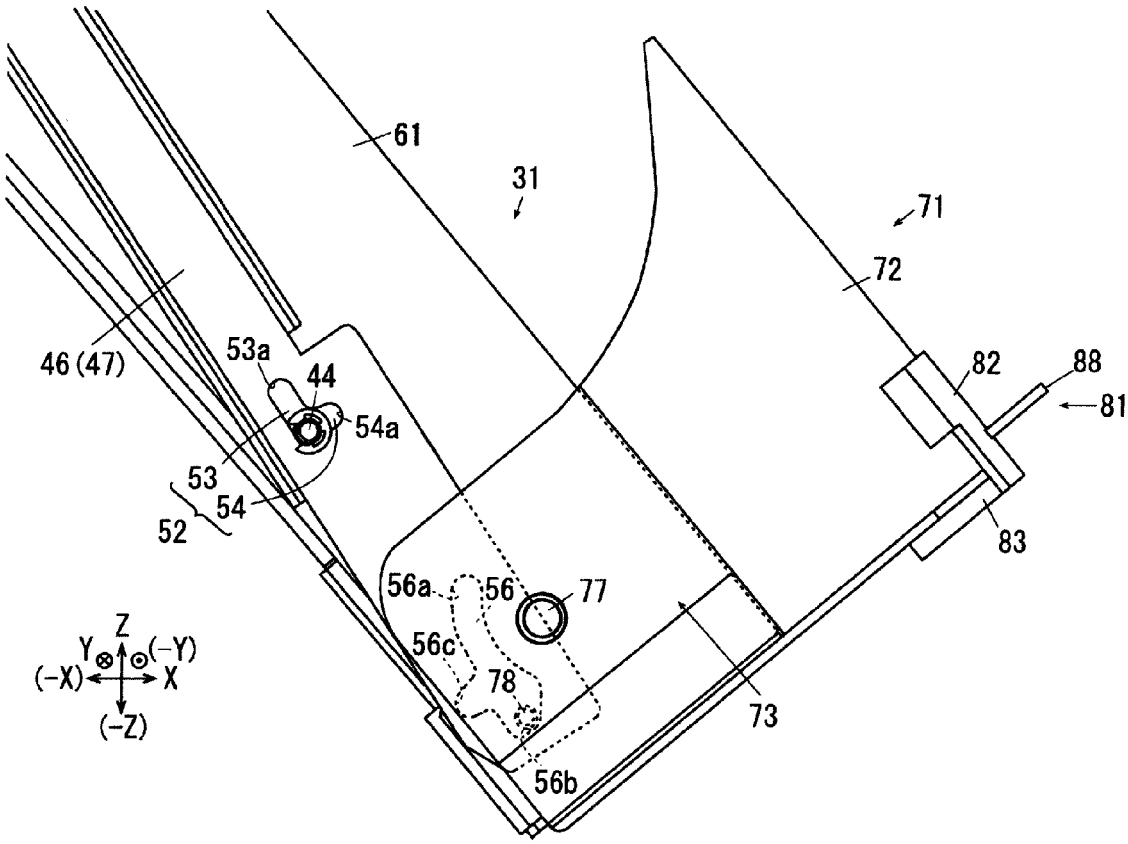
FIG. 16 is an explanatory view showing the main part of the front end of the tilting holder according to the first exemplary embodiment of the invention, illustrating a state in which the tilting holder is moved to the tilting position.

FIG. 16 is an explanatory view showing the main part of the front end of the tilting holder according to the first embodiment, illustrating a state in which the tilting holder is moved to the tilting position.

Figure 17:
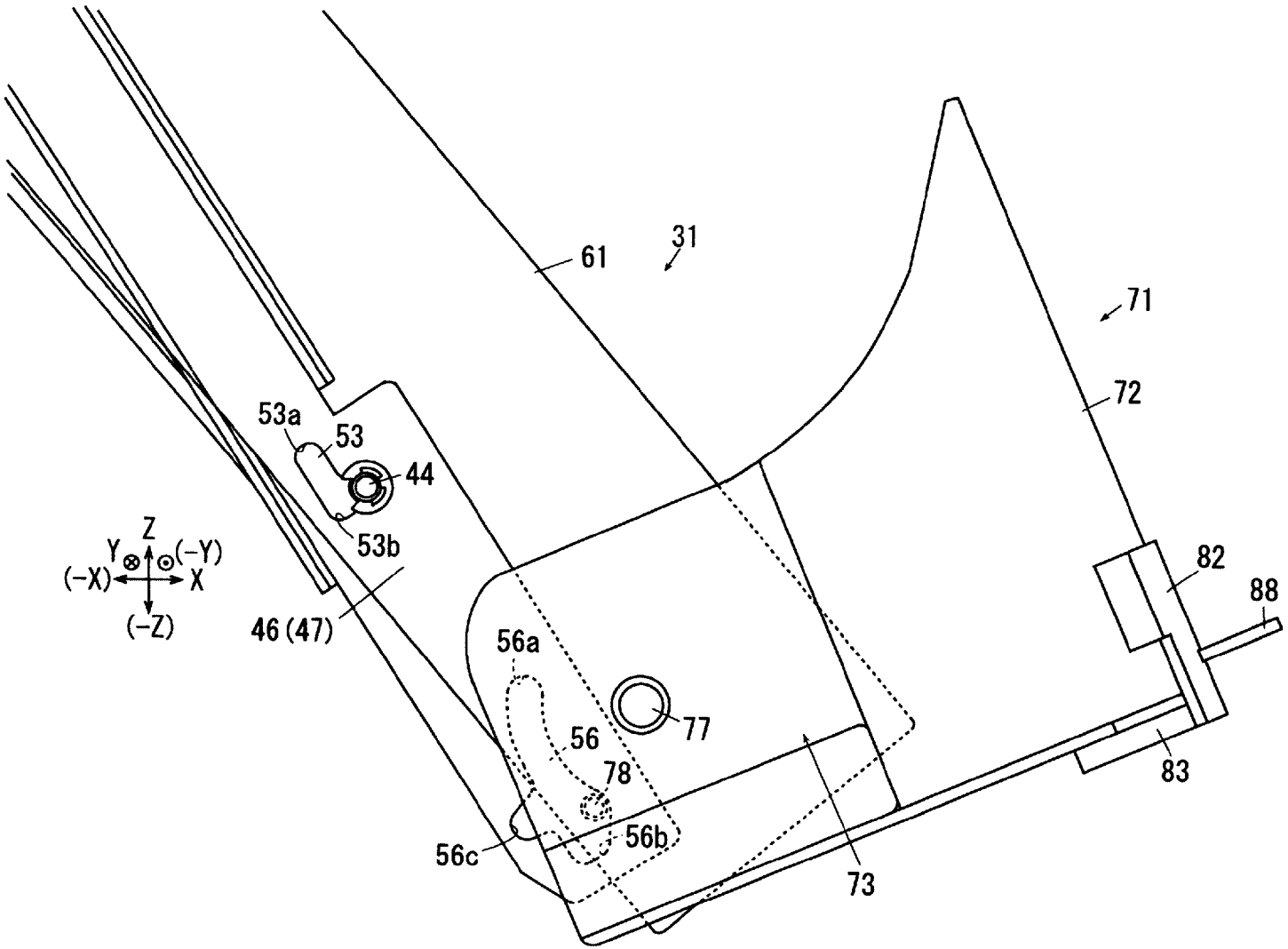
FIG. 17 is an explanatory view showing the main part of the front end of the tilting holder according to the first exemplary embodiment of the invention, illustrating a state in which the front end cover is started to be rotated toward the front end opening position in the state shown in FIG. 16.

FIG. 17 is an explanatory view showing the main part of the front end of the tilting holder according to the first embodiment, illustrating a state in which the front end cover is started to be rotated toward the front end opening position in the state shown in FIG. 16.

Figure 18:
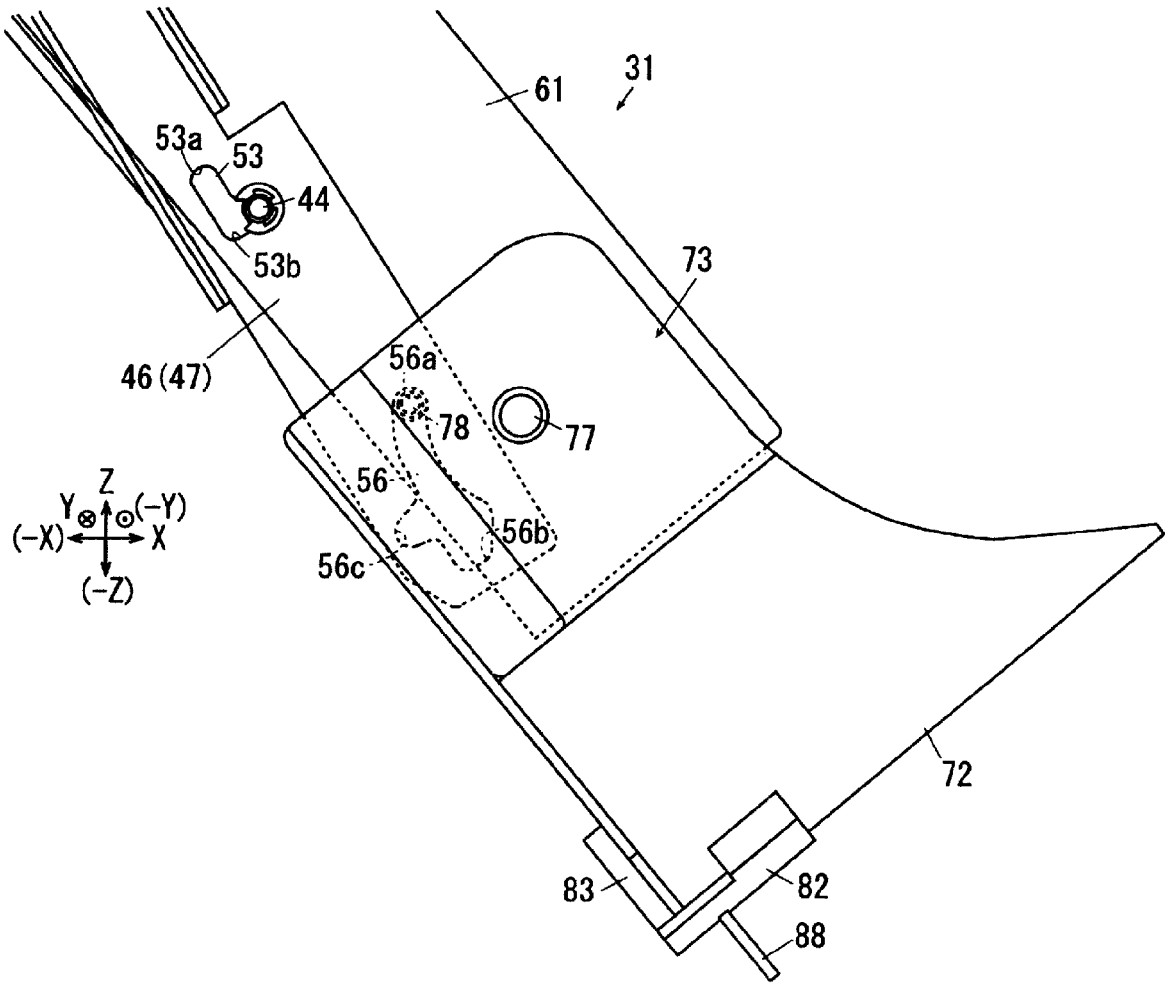
FIG. 18 is an explanatory view showing the main part of the front end of the tilting holder according to the first exemplary embodiment of the invention, illustrating a state in which the front end cover is moved to the front end opening position in the state shown in FIG. 17.

FIG. 18 is an explanatory view showing the main part of the front end of the tilting holder according to the first embodiment, illustrating a state in which the front end cover is moved to the front end opening position in the state shown in FIG. 17.

In FIGS. 13 to 18, a lock opening 56 penetrating through each of the supports 46 and 47 in a transverse direction as an embodiment of a rotation interlocked portion is formed on a front end of each of the supports 46 and 47.

In FIG. 15, the lock opening 56 has a cover stud guide groove 56*a* as an embodiment of a guiding portion which is extended like a convexed circular arc in a downward direction from a rear end side, a support unlocking portion 56*b* as an embodiment of a rotating regulation releasing portion which is linked to a front end of the cover stud guide groove 56*a* and has an inner side surface tilted downward in a forward direction, and then extended downward in a direction of a gravity, and a cover locking portion 56*c* as an embodiment of an opening/closing movement regulating portion which is formed integrally with the support unlocking portion 56*b* and taking a concave shape in a downward direction with respect to a lower surface of the support unlocking portion 56*b*.

Figure 19:
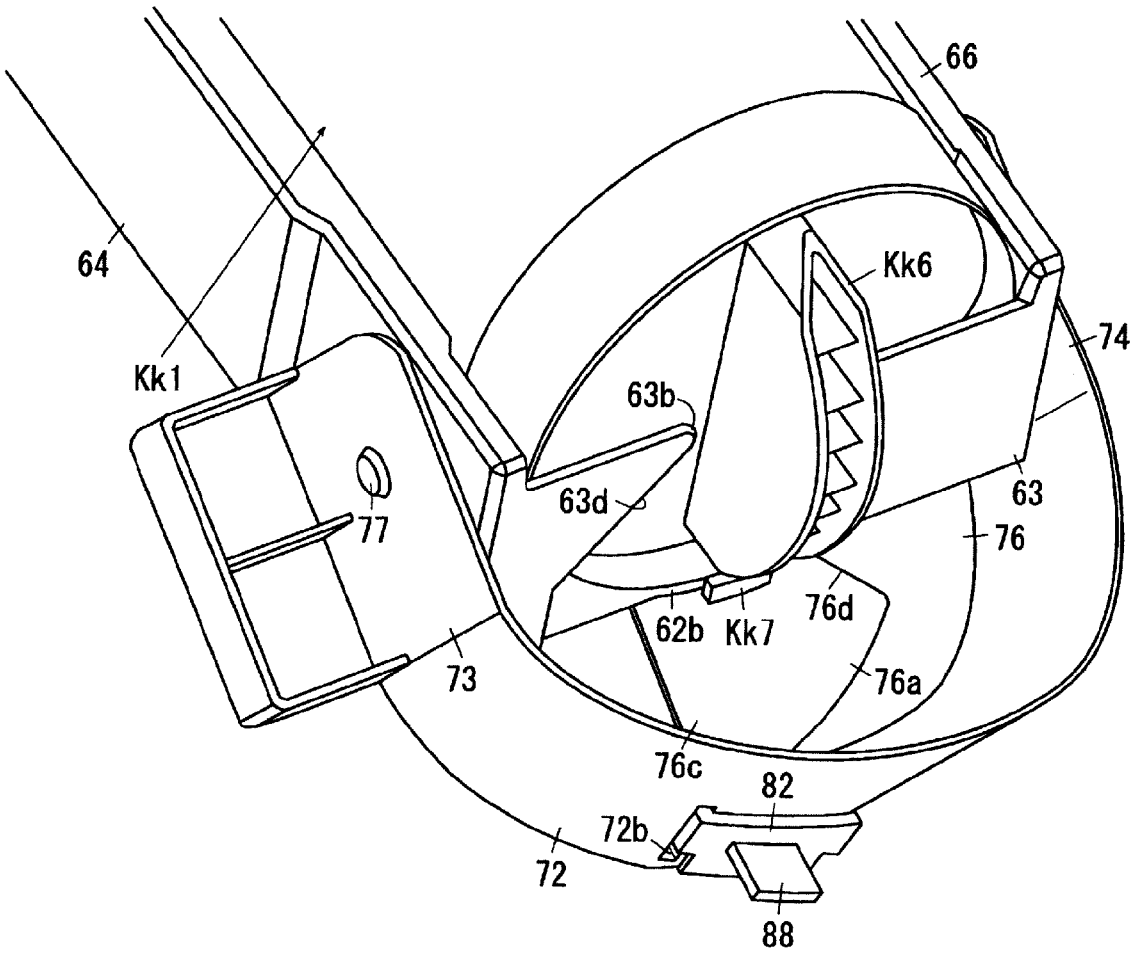
FIG. 19 is an explanatory view showing main parts of the tilting holder and the front end cover according to the first exemplary embodiment of the invention, illustrating a state in which the toner cartridge corresponding to FIG. 6 is attached.

FIG. 19 is an explanatory view showing main parts of the tilting holder and the front end cover according to the first embodiment, illustrating a state in which the toner cartridge corresponding to FIG. 6 is attached.

In FIGS. 7 and 11 to 14, a holder cover 61 as an embodiment of a holding body covering member is fixed and supported on the holder frame 36. The holder cover 61 has an upper cover 62 as an embodiment of an upper covering portion which is disposed on a front side and both left and right sides of a bottom wall 36*a* of the holder frame 36. The upper cover 62 has a cartridge holding surface 62*a* as an embodiment of a removable member holding surface to be a semi-cylindrical upper surface. In FIGS. 12 and 19, a front end of the upper cover 62 is provided with a rib contact portion 62*b* as an embodiment of a push-in received portion. The push-in rib Kk7 can come in contact with the rib contact portion 62*b*.

In FIG. 19, a front end wall 63 is formed integrally with a front end of the upper cover 62. In FIG. 12, a fan-shaped holder side handle rotating port 63*a* as an embodiment of a removable member position regulating portion and an embodiment of an operating portion passing port is formed to take a cut-out shape in a central part of the front end wall 63. The holder side handle rotating port 63*a* has a handle passing port 63*b* through which the handle Kk6 of the toner cartridge Kk passes therethrough when the toner cartridge Kk is to be attached and removed, and a right end of the handle passing port 63*b* is provided with a holder side removal regulating surface 63*c* extended in a downward direction and a left end of the handle passing port 63*b* is provided with a holder side rotation regulating surface 63*d* which is tilted downward in a leftward direction.

At a left upper edge of the upper cover 62, a left cover 64 for covering an outside of the left sidewall 36*b* and the left support 46 is formed integrally with the upper cover 62. A rear end of the left cover 64 is provided with a rear end protecting portion 64*a*. The rear end protecting portion 64*a* is formed in a greater width in a transverse direction than that in a central part in a longitudinal direction in order to prevent the left support 46 and the one-way hinge 38 from being exposed to an outside and to fill in a clearance between the left sidewall 36*b* and the guided rail 21 on the left side.

At a right upper edge of the upper cover 62, a right cover 66 for covering an outside of the right sidewall 36*c* and the right support 47 is formed integrally with the upper cover 62.

A holding member body (36+61) for holding the toner cartridge Kk is constituted by the holder frame 36 and the holder cover 61.

Figure 20B:
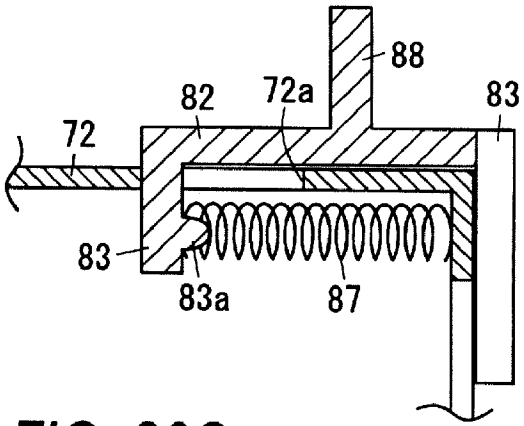
FIGS. 20A to 20C are explanatory views showing a main part of a state in which the front cover of the tilting holder according to the first exemplary embodiment of the invention is moved to the front end closing position, FIG. 20A being a perspective view, FIG. 20B being a sectional view taken along an XXB-XXB line in FIG. 20A, and FIG. 20C being a sectional view taken along an XXC-XXC line in FIG. 20A.
Figure 20C:
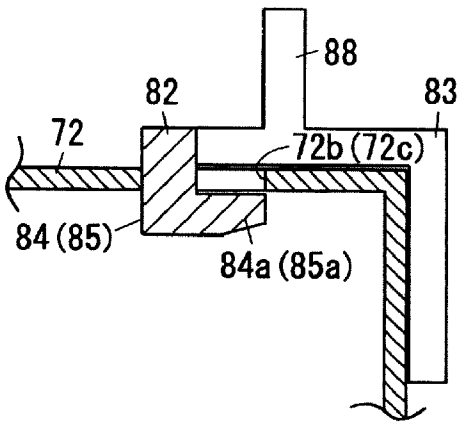
Figure 20A:
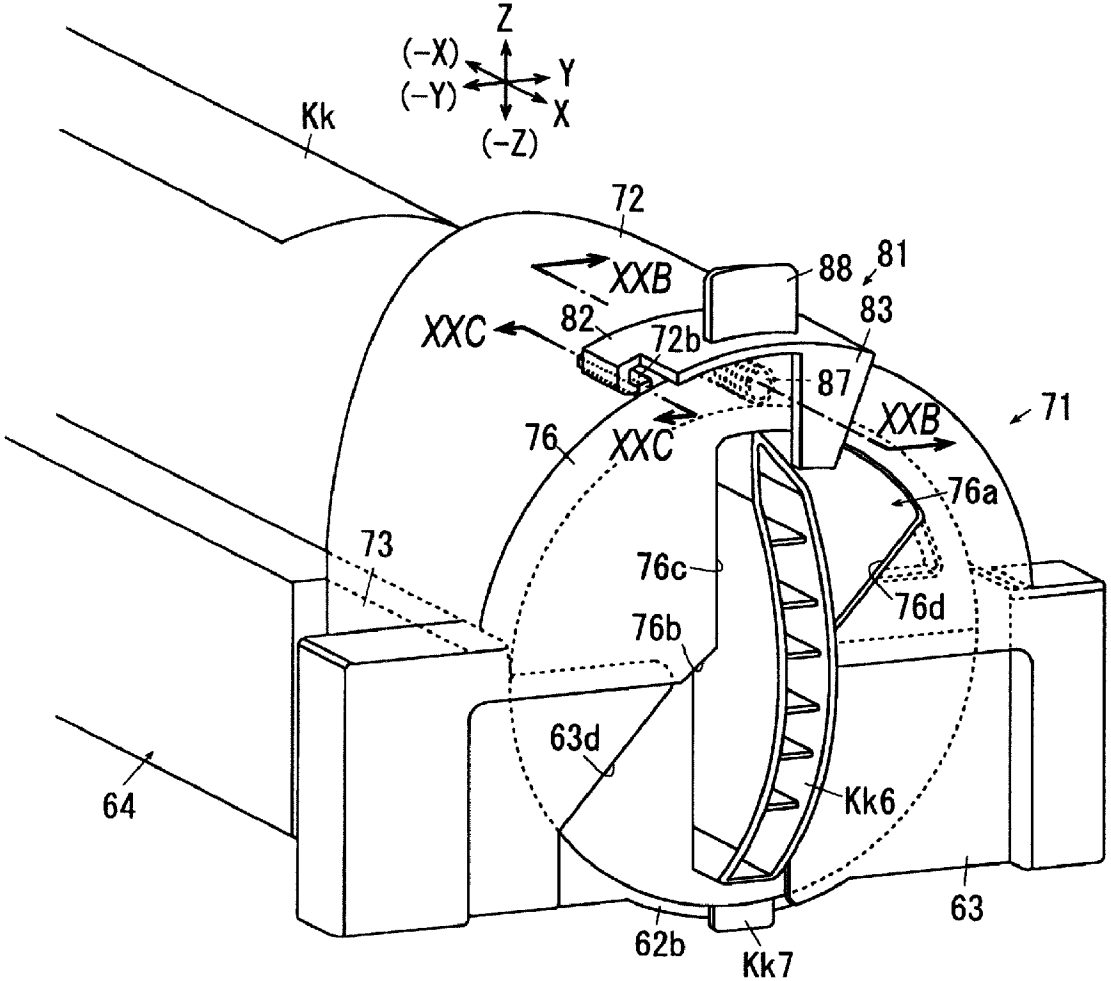

FIGS. 20A to 20C are explanatory views showing a main part in a state in which the front cover of the tilting holder according to the first embodiment is moved to the front end closing position, and FIG. 20A is a perspective view, FIG. 20B is a sectional view taken along an XXB-XXB line in FIG. 20A, and FIG. 20C is a sectional view taken along an XXC-XXC line in FIG. 20A.

In FIGS. 3 to 7 and FIGS. 11 to 20, a front cover 71 as an embodiment of a front end opening/closing member is supported on a front end of the holder cover 61. In FIGS. 15 to 20, the front cover 71 has a front cover cylinder wall 72 taking a semicylindrical shape, a front cover left wall 73 and a front cover right wall 74 which are extended along the left cover 64 and the right cover 66 from both of left and right ends of the front cover cylinder wall 72, and a front cover front wall 76 formed on a front end of the cover cylinder wall 72 corresponding to the front end wall 63.

The front cover left wall 73 and the front cover right wall 74 are provided with a cover rotating shaft 77 which is extended inward in a transverse direction and is rotatably supported on the left cover 64 and the right cover 66. Therefore, the front cover 71 according to the first embodiment is supported rotatably around a cover rotating shaft 77 between the front end closing position shown in FIGS. 6, 7, 11, 13, 15, 16 and 20 and the front end opening position shown in FIGS. 5, 12, 14, 18 and 19.

Moreover, the front cover left wall 73 and the front cover right wall 74 are provided with a lock stud 78 as an embodiment of a rotation interlocking portion which is protruded inward in a transverse direction in a position placed apart downward at a front side of the cover rotating shaft 77 and corresponding to the lock opening 56 of each of the supports 46 and 47 in the front end closing position shown in FIGS. 13 and 15. The lock stud 78 is fitted in the lock opening 56 and is coupled in a state in which it can be moved in the lock opening 56 in a rotation of the front cover 71 or that of the supports 46 and 47.

In FIGS. 20A to 30C, a cover side handle rotating port 76*a* as an embodiment of a removable member position regulating portion and an embodiment of an operating portion passing port is formed to take a fan-like cut shape in a central part of the front cover front wall 76. In the front end closing position in FIGS. 20A to 20C, the cover side handle rotating port 76*a* includes a small width portion 76*b* formed opposite to the handle passing port 63*b* and having a corresponding width to the cartridge handle Kk6, a cover side removal regulating surface 76*c* extended upward from a left end of the small width portion 76*b*, and a cover side rotation regulating surface 76*d* tilted rightward in an upward direction from a right end of the small width portion 76*b*.

Therefore, the toner cartridge Kk according to the first embodiment is supported rotatably within a rotation enabling range between a removing position shown in FIG. 20 in which the cartridge handle Kk6 comes in contact with the removal regulating surfaces 63*c* and 76*c* and the supplying position shown in FIGS. 3A to 3C in which a developer can be supplied in contact with the rotation regulating surfaces 63*d* and 76*d* through a rotation in the removing position.

Moreover, a pull-out regulating member (63+76) is constituted by the front end wall 63 of the holder cover 61 and the front wall 76 of the front cover 71. The pull-out regulating member (63+76) serves to regulate a forward movement of the toner cartridge Kk, thereby preventing a slip-off when tilting the tilting holder 31.

In FIGS. 20A and 20B, a first slit 72*a* as an embodiment of a first guiding groove which is extended in a longitudinal direction is formed on an upper end of the front cover cylinder wall 72 in a state in which the front cover 71 is moved to the front end closing position shown in FIG. 20. In FIGS. 20A and 20C, moreover, a second slit 72*b* and a third slit 72*c* according to a second guiding groove and a third guiding groove are formed in positions placed apart from each other at both of left and right sides of the first slit 72*a* in a circumferential direction on the front cover cylinder wall 72.

In FIGS. 20A to 20C, a handle lock 81 as an embodiment of a rotation stopping member is supported on an upper end of the cover cylinder wall 72. The handle lock 81 has an arcuate plate 82 extended along an outer peripheral surface of the front cover cylinder wall 72. A locking portion 83 as an embodiment of a rotation stopping portion which is extended downward is formed integrally with a front end of the arcuate plate 82. The locking portion 83 has a lower end which enters an inner part of the cover side handle rotating port 76*a*, and is disposed in such a position that the cartridge handle Kk6 moved to the removing position shown in FIGS. 20A to 20C can be interposed from left and right between the locking portion 83 and the cover side removal regulating surface 76*c*.

The arcuate plate 82 has guided portions 83, 84 and 85 formed in corresponding positions to the slits 72*a* to 72*c* of the cover cylinder wall 72. The guided portions 83, 84 and 85 are fitted in the slits 72*a* to 72*c* and have smaller lengths in the longitudinal direction than lengths of the slits 72*a* to 72*c*. A projection 83*a* protruded toward the front cover front wall 76 side is formed on a lower end of the first guided portion 83 to be fitted in the first slit 72*a*, and a locking spring 87 according to an energizing member is attached between the projection 83*a* and the front cover front wall 76. Slip-off preventing portions 84*a* and 85*a* extended toward the front cover front wall 76 side are formed on lower ends of the second guided portion 84 and the third guided portion 85 which are to be fitted in the second slit 72*b* and the third slit 72*c*.

Accordingly, the handle lock 81 is supported movably in a longitudinal direction along the slits 72*a* to 72*c*.

Figure 21:
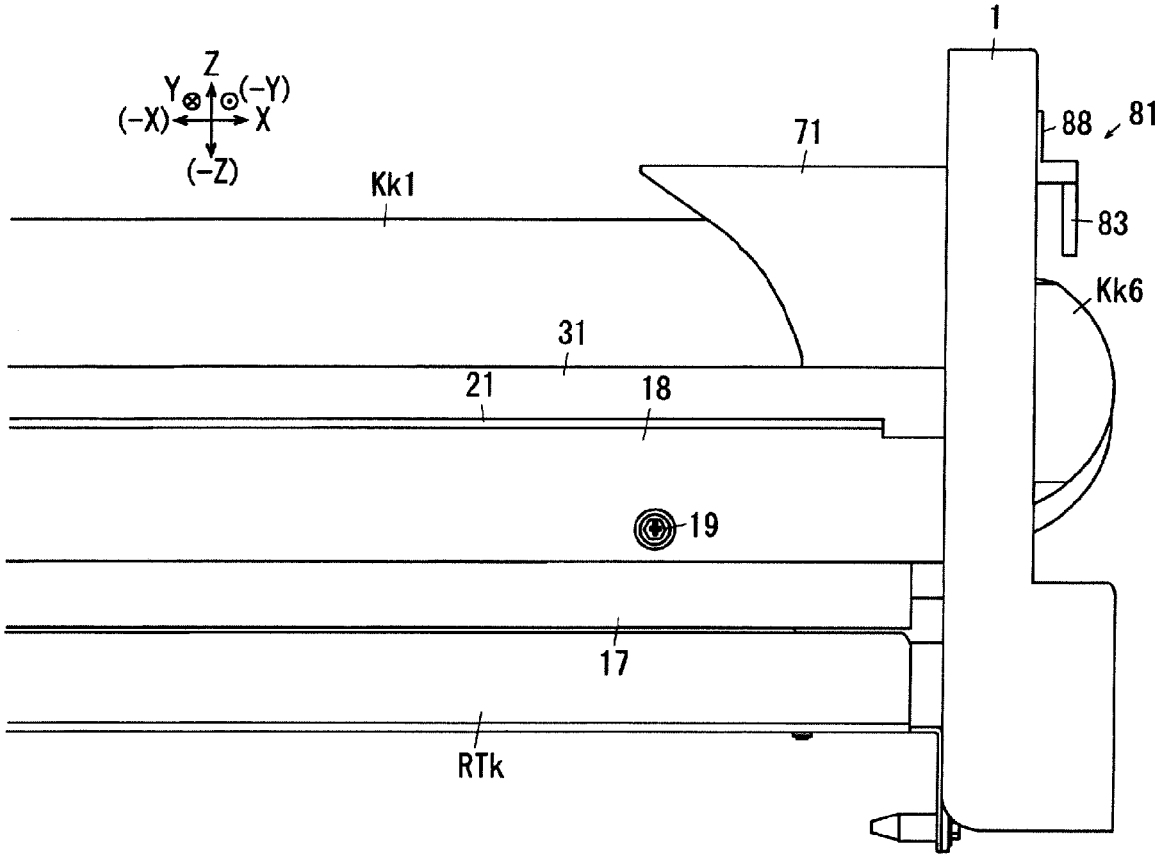
FIG. 21 is an explanatory view showing a positional relationship between a handle lock and a front side frame in the accommodating position illustrated in FIGS. 3A to 3C.

FIG. 21 is an explanatory view showing a positional relationship between the handle lock and the front side frame in the accommodating position illustrated in FIGS. 3A to 3C.

In FIGS. 20A to 20C, a contact portion 88 as an embodiment of a regulation releasing portion protruded upward is formed on an upper surface of the arcuate plate 82. In FIG. 21, the contact portion 88 is formed in a position in which it can come in contact with a handle unlocking portion 1*b* as an embodiment of a contact portion constituted by a front end face of the front side frame 1 on an edge of the opening 1*a* in a state in which the tilting holder 31 is moved to the accommodating position.

Therefore, the handle lock 81 according to the first embodiment is held in a locking position as an embodiment of a rotation regulating position in which the contact portion 88 separates from the front end face of the front side frame 1 so that the guided portions 83 to 85 come in contact with rear ends of the slits 72*a* to 72*c* by an elastic force of the locking spring 87 in a state in which the tilting holder 31 is pulled out forward from the accommodating position. In this state, the locking portion 83 is moved rearward and the cartridge handle Kk6 of the held toner cartridge Kk is interposed between the locking portion 83 and the cover side removal regulating surface 76*c* and is held in a state in which a rotation is regulated. In FIG. 21, in a state in which the tilting holder 31 is moved to the accommodating position, the contact portion 88 comes in contact with the front end face of the front side frame 1 so that the handle lock 81 is moved to a rotation permitting position which is moved forward along the slits 72*a* to 72*c* against the elastic force of the locking spring 87. In the rotation permitting position, the locking portion 83 is maintained apart from the front end of the cartridge handle Kk6 in a forward direction. By rotating the cartridge handle Kk6, it is possible to rotate the toner cartridge Kk.

Function of First Embodiment

In the image forming apparatus U according to the first embodiment of the invention which has the structure, when an image forming operation, that is, a job is executed so that the developer is consumed by each of the developing devices GG to GK, the toner dispenser device U3*a* is operated depending on an amount of the consumption so that the developer is supplied from each of the toner cartridges Kg to Kk. When the developers in the toner cartridges Kg to Kk are used up, the toner cartridges Kg to Kk are exchanged.

(Explanation of Work for Removing Toner Cartridge)

In FIGS. 3A to 3C, in the case in which the empty toner cartridge Kk is exchanged, the cartridge handle Kk6 of the toner cartridge Kk is operated to rotate the toner cartridge Kk from the outlet opening position shown in FIG. 3B to the outlet closing position shown in FIG. 3C in the accommodating position shown in FIGS. 3A to 3C. With the rotation of the toner cartridge Kk, the outlet Kk3 and the inlet 9 are closed by the cartridge shutter Kk4 and the body side shutter 12.

When the toner cartridge Kk is rotated to the outlet closing position, the outlet portion Kk2 is moved to the shutter passing groove 6 so that the toner cartridge Kk, the guided rails 21 and 22 and the tilting holder 31 can be pulled out forward. When the cartridge handle Kk6 of the toner cartridge Kk is operated and is thus pulled out forward from the accommodating position, the handle lock 81 is moved to the rotation regulating position by the elastic force of the locking spring 87 so that the cartridge handle Kk6 of the toner cartridge Kk is held in a rotation disabling state as shown in FIG. 20. Accordingly, the rotation of the toner cartridge Kk during the pull-out work is reduced so that an operability can be enhanced.

In FIGS. 3A-3C and 4, the toner cartridge Kk pulled out forward from the accommodating position shown in FIGS. 3A to 3C can be pulled out to the pull-out position shown in FIG. 4 in which the stopper 24 of each of the guide rails 21 and 22 comes in contact with the screw 19 of the guide rail 16. In the pull-out position, the hanging portion 42*d* is fitted in the latch hole 51 of each of the supports 46 and 47 as shown in FIG. 11, and the tilting holder 31 is held in the insertion enabling position shown in FIGS. 4 and 11.

In FIGS. 13 and 15, moreover, the lock stud 78 of the front cover 71 is fitted in the cover locking portion 56*c* of the lock opening 56 in the pull-out position. In the insertion enabling position shown in FIGS. 4, 11 and 13, accordingly, the front cover 71 is held in the front end closing position shown in FIG. 13 and is thus brought into a rotation disabling state. Accordingly, it is possible to prevent the front cover 71 from being erroneously moved to the front end opening position and thus opened in the insertion enabling position. Therefore, it is possible to prevent an unexpected accident that the tilting holder 31 is rotated in a rotatable state of the front cover 71 and the toner cartridge Kk forward slips off from the tilting holder 31.

When a user brings the cartridge handle Kk6 on the front end of the toner cartridge Kk held in the insertion enabling position downward, the hanging portion 42*d* slips off from the latch hole 51 against the elastic force of the pin energizing spring 43 so that a movement is started toward a lower tilting position.

In this case, in the tilting holder 31 according to the first embodiment, the one-way hinge 38 is incorporated into the holder rotating shaft 32 and only a smaller rotating force than a natural rotating force is transmitted. In the case in which the one-way hinge 38 is not incorporated, therefore, there is a fear that a rotating speed might be excessively increased in a rotation toward the lower tilting position by a dead weight of the toner cartridge Kk or the tilting holder 31 and the tilting holder 31 rotated at a very high speed might thus collide to break articles or injure the user or the toner cartridge Kk might jump out due to the rotation at the very high speed. In the first embodiment, however, the rotating speed is reduced by the one-way hinge 38. Consequently, an occurrence of accidents is reduced.

When the tilting holder 31 is rotated toward the tilting position, the supports 46 and 47 coupled to each other through the support coupling stud 44 are rotated around the support rotating shaft 48 disposed in the position placed apart from the holder rotating shaft 32. When the tilting holder 31 and the supports 46 and 47 are rotated, the support coupling stud 44 is relatively moved along the guiding groove portion 53 of the tilt stopping groove 52 depending on a difference between rotating tracks of the tilting holder 31 having the positions of the rotating shafts 32 and 48 shifted from each other and the supports 46 and 47 as shown in FIGS. 13, 15 and 16. As shown in FIG. 16, when the support coupling stud 44 comes in contact with the lower rotation locking surface 53*b* on the front end of the guiding groove portion 53, the rotations of the tilting holder 31 and the supports 46 and 47 are regulated and a further tilt in a further downward direction is regulated. More specifically, the movement of the tilting holder 31 to the tilting position shown in FIGS. 5 and 16 is completed so that the supports 46 and 47 are moved to the lower rotating positions.

In the rotation of the tilting holder 31, in the front cover 71 to be moved integrally with the tilting holder 31, the locking stud 78 is moved relatively with the lock opening 56 on the front end of each of the supports 46 and 47 having different rotating tracks from the tilting holder 31 and is changed from the state in which it is fitted in the cover locking portion 56*c* as shown in FIG. 15 to the state in which it comes in contact with the support unlocking portion 56*b* as shown in FIG. 16. When the tilting holder 31 is moved to the tilting position shown in FIG. 16, accordingly, the front cover 71 can be rotated around the cover rotating shaft 77.

In FIGS. 8A and 8B and 9, with the rotation of the tilting holder 31, the link 27 coupled through the link coupling pin 36*d* on the right side is rotated interlockingly and is moved from the stopping portion separating position shown in FIGS. 8A and 8B to the stopping portion contact position shown in FIG. 9. Accordingly, the stopped portion 27*b* comes in contact with the erroneous insertion stopping portion 16*a* so that the movement of the guided rails 21 and 22 toward the accommodating position is regulated. During the tilt of the tilting holder 31 or the exchange of the toner cartridge Kk, therefore, it is possible to reduce the erroneous movement of the guided rails 21 and 22 or the tilting holder 31 toward the accommodating positions.

In the tilting holder 31 according to the first embodiment, moreover, the support rotating shaft 48 of the supports 46 and 47 is disposed in the vicinity of the holder rotating shaft 32 so that a forward jumping amount of each of the guided rails 21 and 22 can be lessened. In the cartridge holder KHk according to the first embodiment, therefore, it is possible to reduce the damage of the user touching the jumping guided rails 21 and 22 more greatly as compared with the case in which the guided rails 21 and 22 jump forward.

If the support rotating shaft 48 and the holder rotating shaft 32 are close to each other, moreover, the rotating track of the tilting holder 31 approximates to that of each of the supports 46 and 47. In a moving state to the tilting state, therefore, a shift of the relative positions of the supports 46 and 47 with respect to the tilting holder 31 is lessened so that the jumping amounts of the supports 46 and 47 from the lower surface of the tilting holder 31 are reduced. Consequently, there is also reduced the unexpected accident that the damage is caused by a contact with the jumping supports 46 and 47.

When the front cover 71 is rotated from the front end closing position shown in FIG. 5 to the front end opening position shown in FIG. 6 in the moving state to the tilting position, the locking stud 78 is rotated along the cover stud guide groove 56*a* of the lock opening 56. When the locking stud 78 separates from the support unlocking portion 56*b* and is moved to the cover stud guide groove 56*a*, the supports 46 and 47 are rotated. As shown in FIGS. 14 and 17, the supports 46 and 47 are moved to the rotation regulating position in which the support coupling stud 44 is fitted in the rotation locking surface 54*a* through the lower rotation locking surface 53*b*. In this state, a movement in a direction set along the guiding groove portion 53 is regulated. As a result, the supports 46 and 47 are held in a rotation disabling state, that is, a state in which the tilting holder 31 cannot be rotated from the tilting position toward the insertion enabling position. Accordingly, it is possible to prevent the tilting holder 31 from being rotated toward the insertion enabling position by mistake in a state in which the front cover 71 is opened.

When the front cover 71 is moved to the front end opening position shown in FIG. 6, the cover side handle rotating port 76*a* separates from the cartridge handle Kk6 so that the toner cartridge Kk can be removed from the tilting holder 31 as shown in FIG. 7. When the toner cartridges Kg to Kk to be attached/removed to/from the upper part of the image forming apparatus U are to be attached or removed, therefore, an operator who is short or uses a wheel chair can also exchange the toner cartridges Kg to Kk easily in the image forming apparatus U according to the first embodiment as compared with the conventional structure in which a movement in only a longitudinal direction is carried out and a lower tilting state is not brought differently from the tilting holder 31.

(Explanation of Work for Attaching Toner Cartridge)

In FIG. 7, in the case in which the new toner cartridge Kk is attached, the cartridge handle Kk6 is guided to the holder side removal regulating surface 63*c* of the holder side handle rotating port 63*a* so that the new toner cartridge Kk is attached to the cartridge holding surface 62*a* to bring the state shown in FIG. 6. As shown in FIG. 6, in a state in which the front cover 71 is moved to the front end opening position, the tilting holder 31 is brought into the rotation disabling state by a contact of the rotation locking surface 54*a* with the support coupling stud 44, and is brought into the insertion disabling state by the contact of the stopped portion 27*b* of the link 27 with the inserting prevention stopping portion 16*a*. Accordingly, it is possible to prevent the tilting holder 31 from being rotated or inserted in a state in which the front cover 71 is forgot to be closed.

In FIGS. 5 and 6, when the front cover 71 is rotated toward the front end closing position, it is moved to the front end closing position shown in FIG. 16 via the state shown in FIG. 17. In the front end closing position shown in FIG. 16, the support coupling stud 44 comes in contact with the lower rotation locking surface 53*b* so that an upward rotation of the supports 46 and 47 can be carried out. Also in this state, the stopped portion 27*b* of the link 27 and the inserting prevention stopping portion 16*a* come in contact with each other so that the guided rails 21 and 22 are held in the insertion disabling state.

When the front cover 71 is moved to the front end closing position, the cartridge handle Kk6 is interposed between the locking portion 83 and the cover side removal regulating surface 76*c* so that the rotation is regulated. Accordingly, there is reduced a situation in which the cartridge Kk is rotated with respect to the tilting holder 31 and a different operation from an intended operation is carried out during an operation for gripping the cartridge handle Kk6.

In FIGS. 4 and 5, when the tilting holder 31 is rotated upward from the tilting position shown in FIG. 5, it is moved toward the insertion enabling position shown in FIG. 4. At this time, a rotating force of the one-way hinge 38 incorporated into the holder rotating shaft 32 according to the first embodiment is not limited with respect to the rotating direction from the tilting position toward the insertion enabling position. As compared with the case in which the braking member for limiting the rotating forces in both of the rotating directions in addition to one of the rotating directions is used, accordingly, a load for limiting the force of the user to carry out the rotation does not act when rotating the tilting holder 31 in an upward direction. Consequently, the operator can easily rotate the tilting holder 31 into the insertion enabling position. Even if the operator releases the tilting holder 31 by mistake during an upward movement to the insertion enabling position, the rotation from the insertion enabling state toward the tilting position has a rotating force limited so that it is possible to prevent a drop at a very high speed, resulting in a reduction in an accident that the operator is injured.

In the tilting holder 31 according to the first embodiment, moreover, the rear end protecting portion 64*a* of the left cover 64 fills in the clearance between the left sidewall 36*b* and the guided rail 21 on the left side. Consequently, it is also possible to reduce an accident that a tip of a finger is cut off between the guided rail 21 and the left cover 64 by mistake during the rotating work.

When the movement to the insertion enabling position shown in FIG. 4 is carried out, the hanging portion 42*d* is fitted in the latch hole 51 of each of the supports 46 and 47 so that the operator can recognize that the movement to the insertion enabling position is carried out as shown in FIG. 11. Even if the operator tries to carry out the rotation in a further upward direction from the insertion enabling position, the support coupling stud 44 comes in contact with the upper rotation locking surface 53*a* of the guiding groove portion 53 as shown in FIGS. 11 and 13. Accordingly, the upward rotation of the supports 46 and 47 is regulated and the upward rotation of the tilting holder 31 from the insertion enabling position is regulated.

In the insertion enabling position, furthermore, the lock stud 78 of the front cover 71 is maintained to be fitted in the cover locking portion 56*c* so that it is possible to prevent the front cover 71 from being opened to the front end opening position by mistake.

In the insertion enabling position, moreover, the link 27 is moved to the stopping portion separating position shown in FIGS. 8A and 8B. The stopped portion 27*b* separates from the erroneous insertion stopping portion 16*a* so that the guided rails 21 and 22 can be moved toward the rear accommodating position.

In FIGS. 3A to 3C and 4, when the user pushes the cartridge handle Kk6 in the insertion enabling position shown in FIG. 4, the push-in rib Kk7 of the toner cartridge Kk comes in contact with the rib contact portion 62*b* of the upper cover 62 as shown in FIG. 20 so that the tilting holder 31 and the guided rails 21 and 22 are moved toward the rear accommodating position shown in FIGS. 3A to 3C together with the toner cartridge Kk.

At this time, the toner cartridge Kk according to the first embodiment is held in a state in which the cartridge handle Kk6 is interposed between the locking portion 83 and the cover side removal regulating surface 76*c*, and the outlet portion Kk2 is placed in a corresponding position to the shutter passing groove 6. Accordingly, it is possible to carry out the movement toward the accommodating position via the shutter passing groove 6 without an interference of the outlet portion Kk2.

In FIG. 21, when the tilting holder 31 is moved from the insertion enabling position toward the accommodating position so that the contact portion 88 of the handle lock 81 comes in contact with the front end face of the front side frame 1 on the edge of the opening 1*a*, it is moved relatively with the front cover 71 against the elastic force of the locking spring 87. When the tilting holder 31 is moved to the accommodating position as shown in FIG. 21, therefore, the handle lock 81 is held in the forward jumping position from the cartridge handle Kk6 so that the cartridge handle Kk6 is brought into a rotatable state with respect to the tilting holder 31.

In FIGS. 3A to 3C, when the cartridge handle Kk6 is rotated in a state in which the movement to the accommodating position is carried out to release the rotation regulation of the cartridge handle Kk6 through the handle lock 81, the movement from the outlet closing position shown in FIG. 3C to the outlet opening position shown in FIG. 3B is performed so that the outlet Kk3 and the inlet 9 are opened and connected to each other. Accordingly, the developer can be supplied from the toner cartridge Kk to the reserve tank RTk.

Second Embodiment

Figure 22:
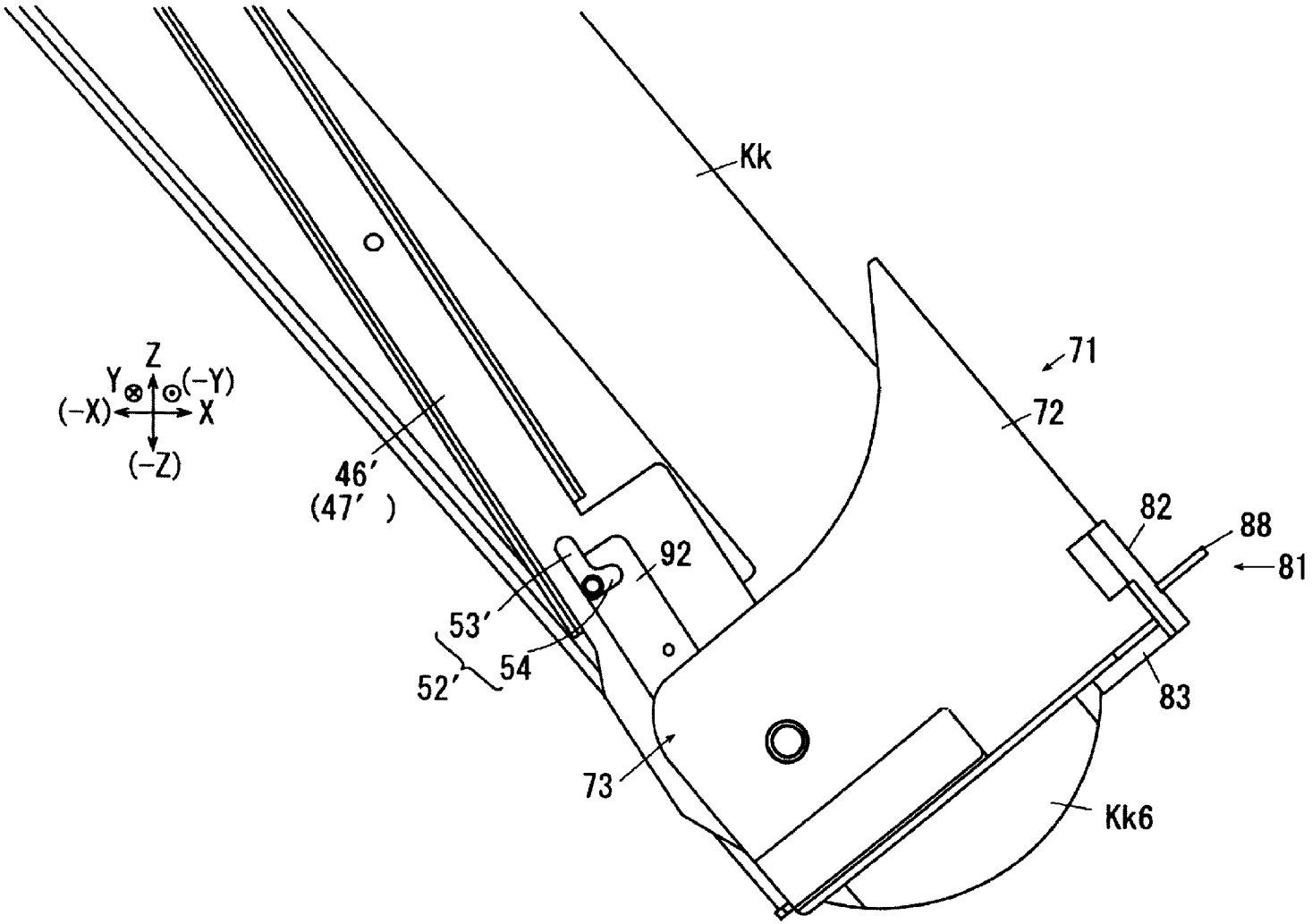
FIG. 22 is an explanatory view showing a lower rotation regulating portion and a rotation regulating portion according to a second exemplary embodiment of the invention, corresponding to FIG. 16 according to the first exemplary embodiment of the invention.

FIG. 22 is an explanatory view showing a lower rotation regulating portion and a rotation regulating portion according to a second exemplary embodiment, corresponding to FIG. 16 according to the first embodiment.

Figure 23A:
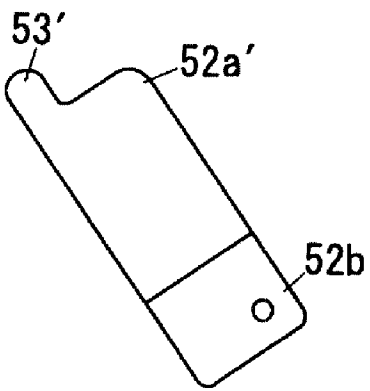
FIGS. 23A to 23D is an explanatory view showing a rotating position regulating member according to the second embodiment, FIG. 23A being an explanatory view showing a rotating position adjusting opening in a state in which the rotating position adjusting member is removed, FIG. 23B being an explanatory view showing a rotating position adjusting member for a shallow rotating position, FIG. 23C being an explanatory view showing a rotating position adjusting member for a middle rotating position, and FIG. 23D being an explanatory view showing a rotating position adjusting member for a deep rotating position.
Figure 23B:
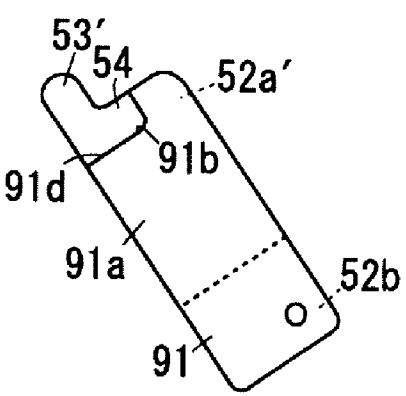
Figure 23C:
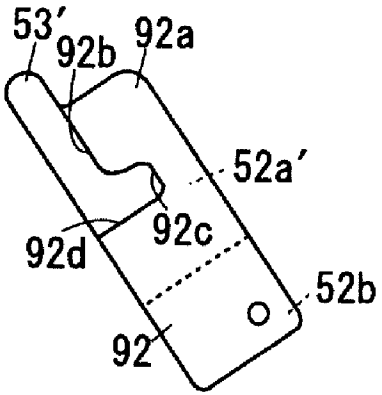
Figure 23C:
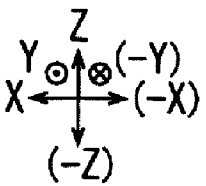
Figure 23D:
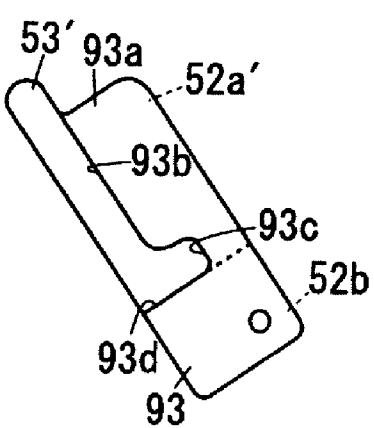

FIGS. 23A to 20D are explanatory views showing a rotation position regulating member according to the second embodiment, and FIG. 23A is an explanatory view showing a rotating position adjusting opening in a state in which the rotating position adjusting member is removed, FIG. 23B is an explanatory view showing a rotating position adjusting member for a shallow rotating position, FIG. 23C is an explanatory view showing a rotating position adjusting member for a middle rotating position, and FIG. 23D is an explanatory view showing a rotating position adjusting member for a deep rotating position.

Next, description will be given to the second embodiment according to the invention. In the description of the second embodiment, components corresponding to the components according to the first embodiment have the same reference numerals and detailed description thereof will be omitted.

Although the second embodiment is different from the first embodiment in the following respects, it has the same structure as that of the first embodiment in the other respects.

In FIGS. 22 and 23A to 23D, in a tilting holder 31 according to the second embodiment, a tilt stopping groove 52' taking an almost square shape is formed in front parts of supports 46' and 47' in place of the L-shaped tilt stopping groove 52 according to the first embodiment. In FIG. 23A, the tilt stopping groove 52' according to the second embodiment has a guiding groove portion 53' extended in a longitudinal direction corresponding to the guiding groove portion 53 according to the first embodiment and a square-shaped rotation adjusting port 52*a'* formed in linkage to a front end of the guiding groove portion 53' and having a width in a vertical direction corresponding to a length in a vertical direction of the rotation regulating groove portion 54 according to the first embodiment. Moreover, an adjusting member attaching portion 52*b* is formed ahead of the rotation adjusting port 52*a'*.

A plate-shaped shallow rotation adjusting plate 91 shown in FIG. 23B, a middle rotation adjusting plate 92 shown in FIG. 23C or a deep rotation adjusting plate 93 shown in FIG. 23D as an embodiment of a rotation adjusting member is selectively supported removably on the adjusting member attaching portion 52*b*.

In FIG. 23B, the shallow rotation adjusting plate 91 has an adjusting plate body 91*a* for blocking a front side of the rotation adjusting port 52*a'* and a shallow rotating groove forming portion 91*b* formed to take a shape obtained by cutting a rear end of the adjusting plate body 91*a* away and forming a rotation regulating groove portion 54 in a clearance together with the rotation adjusting port 52*a'*. In the adjusting plate body 91*a* according to the second embodiment, accordingly, a lower rotation locking surface 91*d* as an embodiment of a lower rotation regulating portion is constituted by a surface corresponding to a forward part of the guiding groove portion 53' in the shallow rotation groove forming portion 91*b*.

In FIG. 23C, the middle rotation adjusting plate 92 has an adjusting plate body 92*a* for blocking the rotation adjusting port 52*a'*, a guiding groove extending portion 92*b* connected to a front end of the guiding groove portion 53' and constituted by a groove extended forward over an extended line, and a middle rotation regulating groove portion 92*c* connected to a front end of the guiding groove extending portion 92*b* and extended upward. In the adjusting plate body 92*a* according to the second embodiment, accordingly, a lower rotation locking surface 92*d* as an embodiment of a lower rotation regulating portion is constituted by a connecting part of the guiding groove extending portion 92*b* and the middle rotation regulating groove portion 92*c*.

In FIG. 23D, the deep rotation adjusting plate 93 has an adjusting plate body 93*a* for blocking the rotation adjusting port 52*a'*, a guiding groove extending portion 93*b* connected to a front end of the guiding groove portion 53' and constituted by a groove extended to a front end of the rotation adjusting port 52*a'* over an extended line, and a deep rotation regulating groove portion 93*c* extended upward from a front end of the guiding groove extending portion 93*b*. In the adjusting plate body 93*a* according to the second embodiment, accordingly, a lower rotation locking surface 93*d* as an embodiment of the lower rotation regulating portion is constituted by a connecting part of the guiding groove extending portion 93*b* and the deep rotation regulating groove portion 93*c*.

In the second embodiment, therefore, a length of the groove obtained by adding the guiding groove portion 53' and the guiding groove extending portions 92*b* and 93*b* is greater in the case in which the middle rotation adjusting plate 92 is attached than that in the case in which the shallow rotation adjusting plate 91 is attached, and is greater in the case in which the deep rotation adjusting plate 93 is attached than that in the case in which the middle rotation adjusting plate 92 is attached.

Function of Second Embodiment

In the image forming apparatus U according to the second embodiment which has the structure, in the case in which the shallow rotation adjusting plate 91 is attached to the rotating position adjusting member attaching portion 52*b*, a support coupling stud 44 is stopped in a tilting position in which it comes in contact with the lower rotating lock 91*d* to be the front end of the guiding groove portion 53' when the tilting holder 31 is tilted.

On the other hand, in the case in which the middle rotation adjusting plate 92 is attached, the support coupling stud 44 passes through the guiding groove portion 53' and is stopped in a tilting position in which it comes in contact with the lower rotation locking surface 92*d* on the front end of the guiding groove extending portion 92*b*. Accordingly, the tilting position in the case in which the middle rotation adjusting plate 92 is attached has a greater rotating angle from the insertion enabling position with respect to the tilting position than that in the case in which the shallow rotation adjusting plate 91 is attached.

In the case in which the deep rotation adjusting plate 93 is attached, similarly, the support coupling stud 44 passes through the guiding groove portion 53' and is stopped in the tilting position in which it comes in contact with the lower rotation locking surface 93*d* on the front end of the guiding groove extending portion 93*b*. Accordingly, the tilting position in the case in which the deep rotation adjusting plate 93 is attached has a further greater rotating angle from the insertion enabling position than the tilting position in the case in which the middle rotation adjusting plate 92 is attached.

In the image forming apparatus U according to the second embodiment, therefore, when the rotation adjusting plates 91 to 93 are attached or removed, a tilting angle in the tilting position of the tilting holder 31 is changed. Thus, it is possible to change and adjust the tilting position depending on uses of a user.

Third Embodiment

Figure 24:
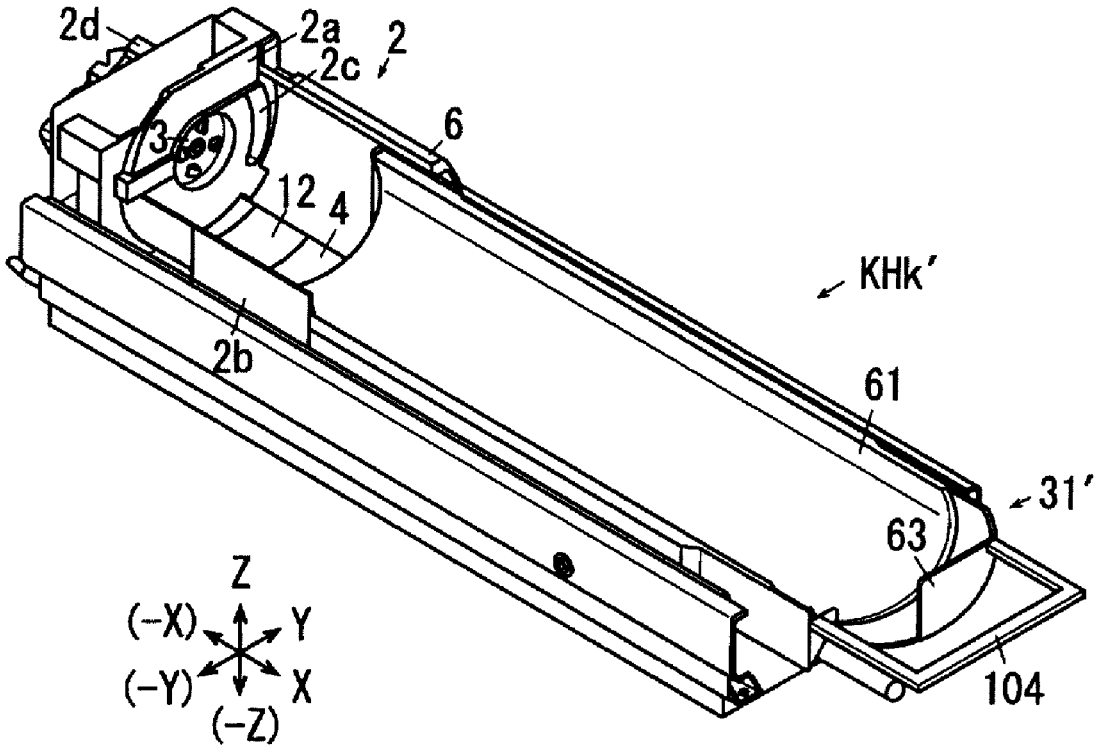
FIG. 24 is an explanatory view showing a state in which a tilting holder according to a third exemplar embodiment of the invention is moved to an accommodating position, corresponding to FIGS. 3A to 3C according to the first exemplary embodiment of the invention.

FIG. 24 is an explanatory view showing a state in which a tilting holder according to a third exemplary embodiment is moved to an accommodating position, corresponding to FIGS. 3A to 3C according to the first embodiment.

Figure 25:
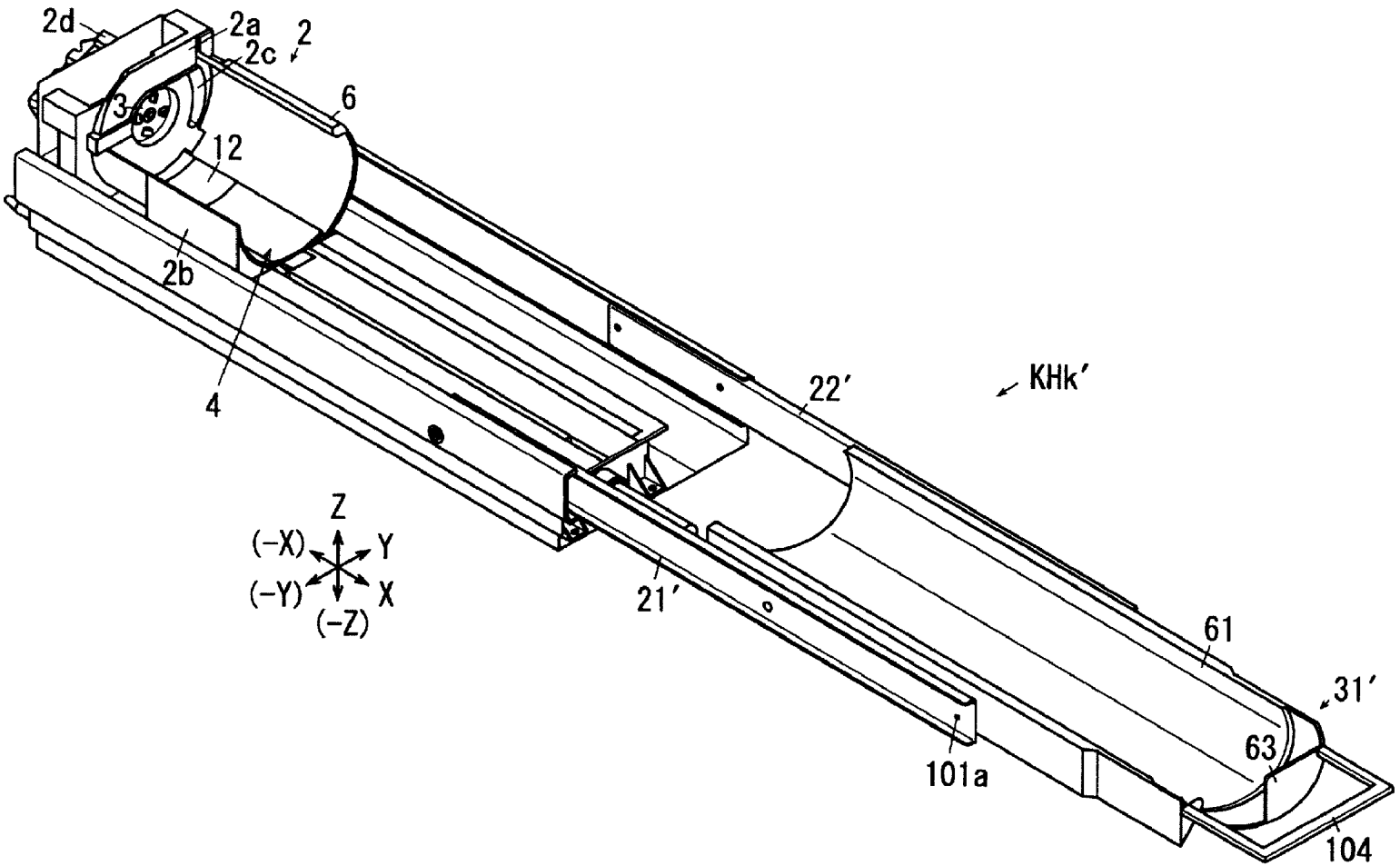
FIG. 25 is an explanatory view showing a state in which the tilting holder according to the third exemplary embodiment of the invention is moved to a pull-out position, corresponding to FIG. 4 according to the first exemplary embodiment of the invention.

FIG. 25 is an explanatory view showing a state in which the tilting holder according to the third embodiment is moved to a pull-out position, corresponding to FIG. 4 according to the first embodiment.

Figure 26:
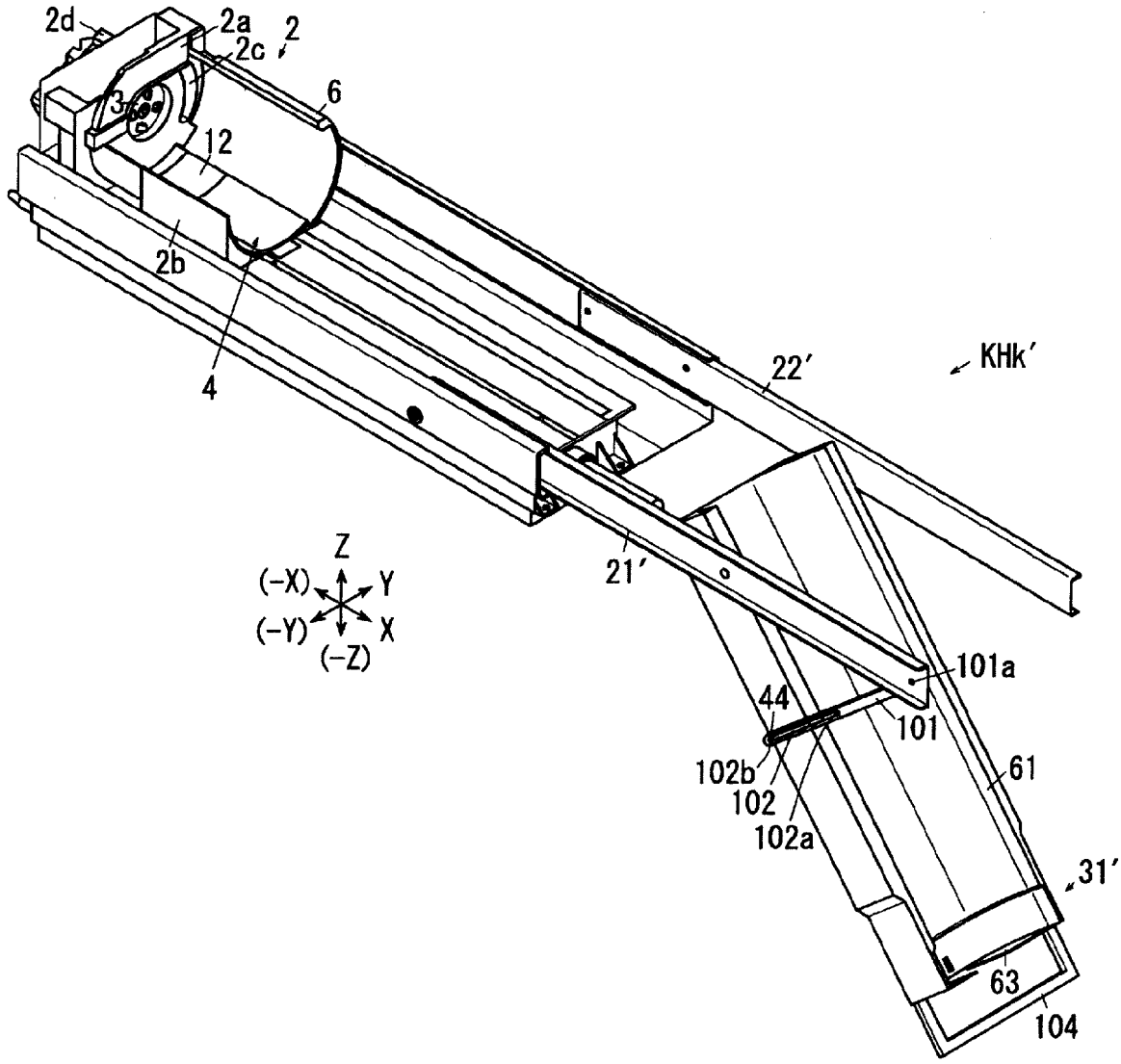
FIG. 26 is an explanatory view showing a state in which the tilting holder according to the third exemplary embodiment of the invention is moved to a tilting position, corresponding to FIG. 5 according to the first exemplary embodiment of the invention.

FIG. 26 is an explanatory view showing a state in which the tilting holder according to the third embodiment is moved to a tilting position, corresponding to FIG. 5 according to the first embodiment.

Next, description will be given to the third embodiment according to the invention. In the description of the third embodiment, components corresponding to the components according to the first embodiment have the same reference numerals and detailed description thereof will be omitted.

Although the third embodiment is different from the first embodiment in the following respects, it has the same structure as that of the first embodiment in the other respects.

In FIGS. 24 to 26, a toner cartridge is not shown.

In FIGS. 24 to 26, in a cartridge holder KHk' according to the third embodiment, guided rails 21' and 22' have lengths in a longitudinal direction set to be greater than those in the guided rails 21 and 22 according to the first embodiment.

In FIG. 26, in the cartridge holder KHk' according to the third embodiment, a support 101 for coupling a front end of the guided rail 21' on a left side to a front end of a tilting holder 31 is supported in place of the supports 46 and 47 according to the first embodiment. The support 101 has a base end as an embodiment of an end which is supported on the guided rail 21' rotatably around a support rotating shaft 101*a*, and a slot-like guiding groove portion 102 extended along the support 101 corresponding to the guiding groove portion 53 according to the first embodiment is formed in a tip part according to the other end. An upper rotation locking surface 102*a* corresponding to the upper rotation locking surface 53*a* according to the first embodiment is formed on the support rotating shaft 101*a* side of the guiding groove portion 102, and a lower rotation locking surface 102*b* corresponding to the lower rotation locking surface 53*b* according to the first embodiment is formed on an opposite side to the upper rotation locking surface 102*a*.

A support coupling stud protruded outward and corresponding to the support coupling stud 44 according to the first embodiment is supported in a fitting state in the guiding groove portion 102 of the support 101. Therefore, the tilting holder 31 according to the third embodiment is supported in a movable state between an insertion permitting position shown in FIG. 25 and a tilting position in which the support coupling stud comes in contact with the lower rotation locking surface 102*b* shown in FIG. 26 by means of the guided rails 21' and 22'.

In the tilting holder 31 according to the third embodiment, furthermore, a front cover 71 is omitted, and a holder handle 104 taking a shape of a handle and extended forward is formed integrally with a front end of a holder cover 61. In the third embodiment, accordingly, there are omitted mechanisms for carrying out locking into the tilting position through an interlocking motion of a rotation of the front cover 71 and the supports 46 and 47 according to the first embodiment and locking the rotation of the front cover 71 in an insertion enabling position. In the third embodiment, moreover, a pull-out regulating member is constituted by only a front end wall 63 of the holder cover 61.

Function of Third Embodiment

In the cartridge holder KHk' according to the third embodiment which has the structure, in the same manner as in the first embodiment, the guided rails 21' and 22' are moved between an accommodating position shown in FIG. 24 and a pull-out position shown in FIG. 25, and furthermore, the tilting holder 31 is moved to the insertion permitting position shown in FIG. 25 and the tilting position shown in FIG. 26. In the tilting position which is tilted more downward than the pull-out position, accordingly, it is possible to exchange the toner cartridge Kk.

Fourth Embodiment

Figure 27:
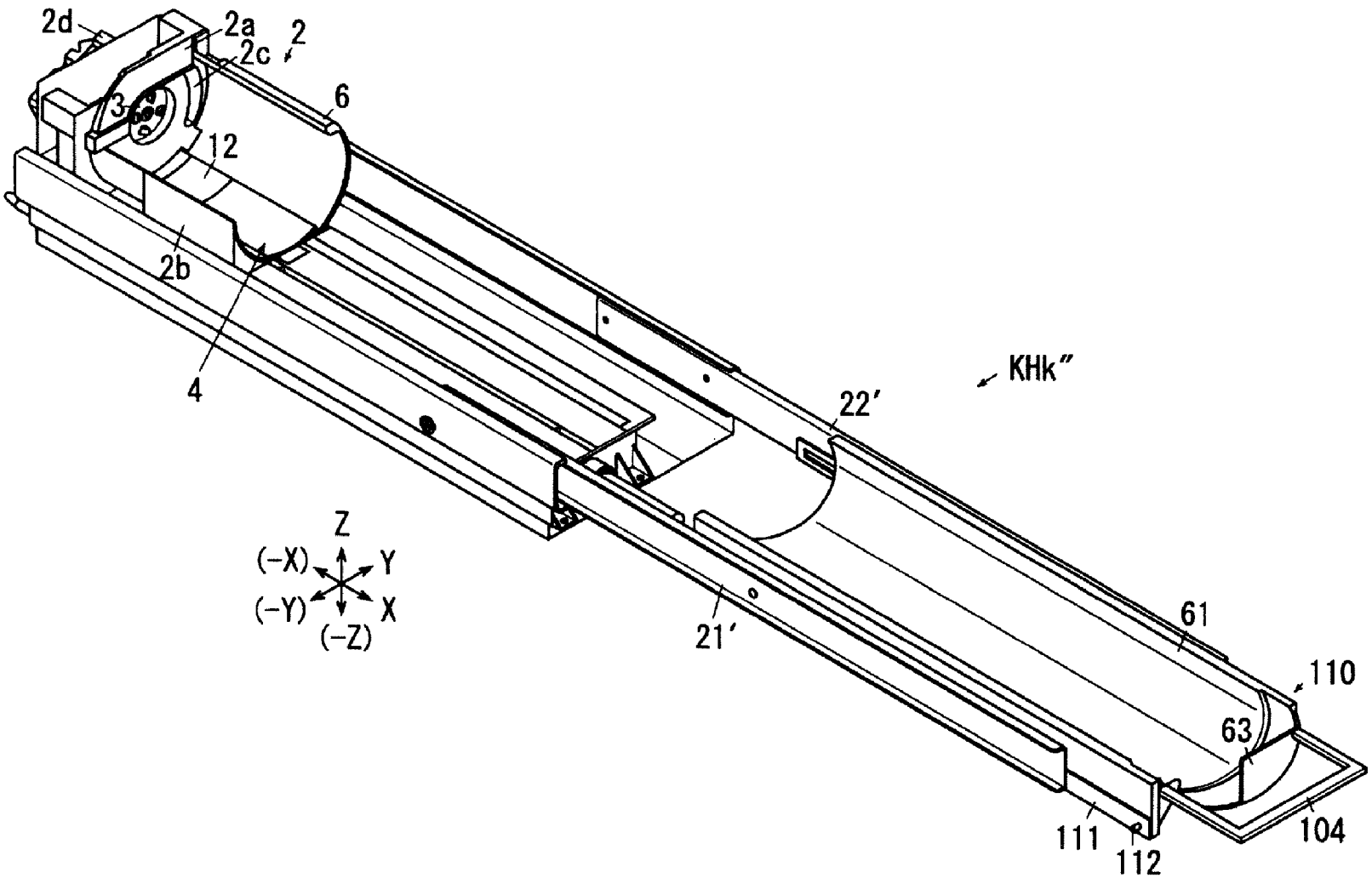
FIG. 27 is an explanatory view showing a state in which a holder according to a fourth exemplary embodiment of the invention is moved to a pull-out position, corresponding to FIG. 4 according to the first exemplary embodiment of the invention.

FIG. 27 is an explanatory view showing a state in which a holder according to a fourth exemplary embodiment is moved to a pull-out position, corresponding to FIG. 4 according to the first embodiment.

Figure 28:
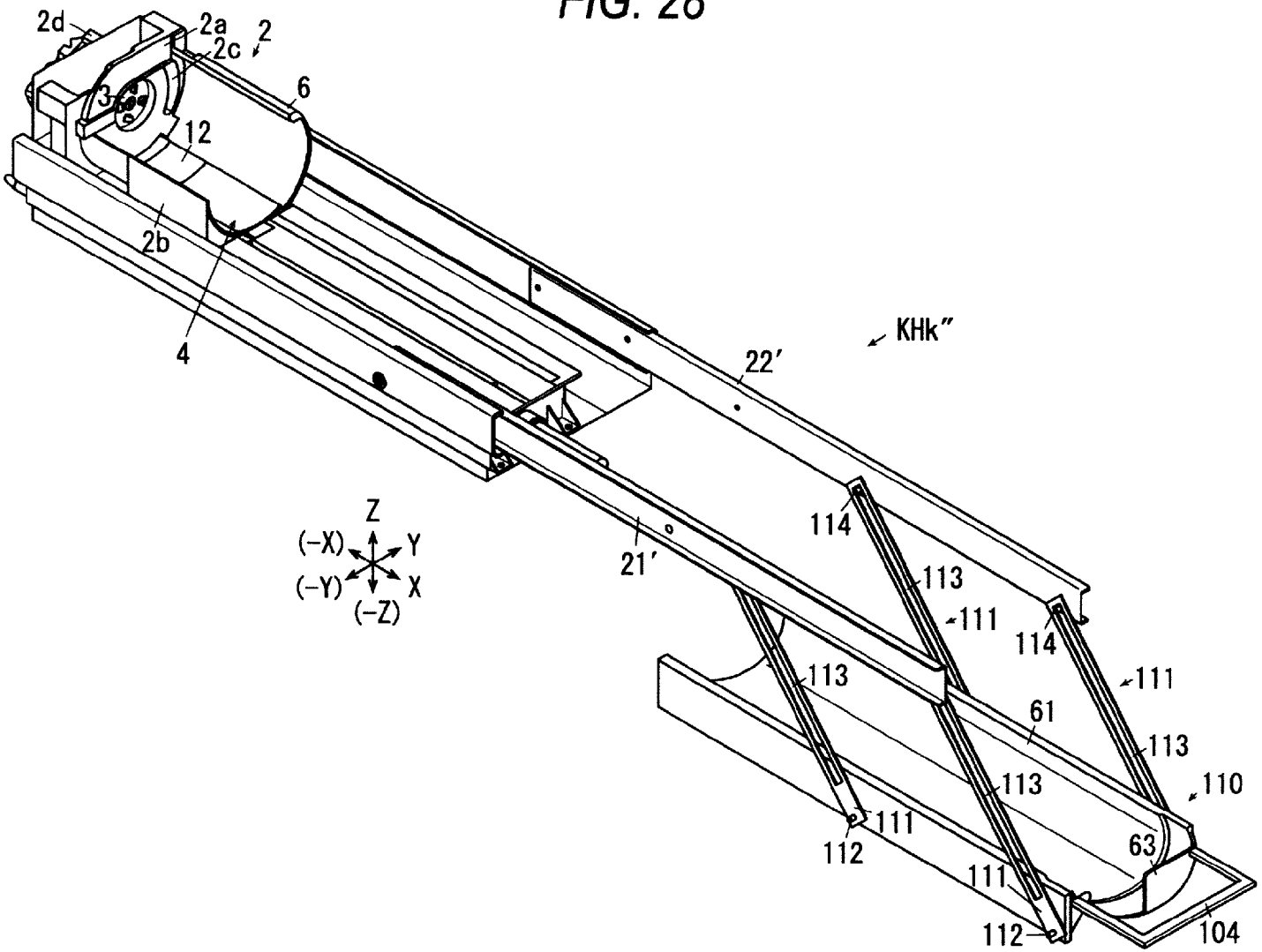
FIG. 28 is an explanatory view showing a state in which the holder according to the fourth exemplary embodiment of the invention is moved to a tilting position, corresponding to FIG. 5 according to the first exemplary embodiment of the invention.

FIG. 28 is an explanatory view showing a state in which the holder according to the fourth embodiment is moved to a tilting position, corresponding to FIG. 5 according to the first embodiment.

Next, description will be given to the fourth embodiment according to the invention. In the description of the fourth embodiment, components corresponding to the components according to the first and third embodiments have the same reference numerals and detailed description thereof will be omitted.

Although the fourth embodiment is different from the first and third embodiments in the following respects, it has the same structure as that of the first embodiment in the other respects.

In FIGS. 27 and 28, in a cartridge holder KHk" according to the fourth embodiment, guided rails 21' and 22' are formed to have greater lengths in a longitudinal direction as compared with the guided rails 21 and 22 according to the first embodiment in the same manner as in the third embodiment.

In the cartridge holder KHk" according to the fourth embodiment, moreover, the guided rails 21' and 22' and a holder 110 as an embodiment of a holding member are coupled to each other through four supports 111 constituted by four parallel links, that is, front, rear, left and right parallel links. The support 111 has a base end as an embodiment of one of ends which is coupled rotatably by means of a support coupling stud 112 protruded outward in a transverse direction from the holder 110. A slot-shaped guiding groove portion 113 is extended along the support 111 from the guided rails 21' and 22' sides, and a support coupling shaft 114 as an embodiment of an auxiliary rotating shaft extended inward from the guided rails 21' and 22' is fitted in the guiding groove portion 113. Accordingly, support coupling shafts 114 of the guided rails 21' and 22' are moved relatively along the guiding groove portions 113 so that the holder 110 is supported movably between an insertion enabling position moved upward as shown in FIG. 27 and a removing position placed downward as shown in FIG. 28 with respect to the guided rails 21' and 22'.

Moreover, the holder 110 according to the fourth embodiment has a holder handle 104 in the same manner as in the third embodiment.

With the structure according to the fourth embodiment, the one-way hinge 38 according to the first embodiment is omitted.

Function of Fourth Embodiment

In the cartridge holder KHk" according to the fourth embodiment which has the structure, in the same manner as in the first and third embodiments, the guided rails 21' and 22' are moved between an accommodating position and a pull-out position shown in FIG. 27, and furthermore, the holder 110 is movable between an insertion enabling position and a removing position. Therefore, it is possible to obtain a structure in which a toner cartridge Kk can be removed in the removing position placed downward from the insertion enabling position.

(Variant)

Although the embodiments according to the invention have been described above in detail, the invention is not restricted to the embodiments but various changes can be made without departing from the scope of the invention which has been described in the claims. Variants (H01) to (H014) according to the invention will be described below.

(H01) Although the image forming apparatus U is constituted by a so-called composite machine in the embodiments, the invention is not restricted thereto but the image forming apparatus U can also be constituted by a printer or an FAX, for instance.

(H02) In the embodiments, the image forming apparatus U is not restricted to the structure in which the toners having the six colors are used but can also employ a structure in which toners having five colors or less or seven colors or more are used, for instance.

(H03) Although the toners having the six colors of G: green, O: orange, Y: yellow, M: magenta, C: cyan and K: black are used in the embodiments, the invention is not restricted thereto but it is also possible to use toners having colors other than the six colors in place of the toners having G: green and O: orange, for instance. In addition, it is also possible to use a colorless toner for coating a surface of an image to obtain a watertightness or protection, to set a color symbolizing an organization such as a company or a group, that is, a so-called corporate color, and to use a magnetic toner for forming a magnetic wire having a preset shape or array, for instance, a linear shape in an image of a printing paper to obtain a burglar-proof property. A burglar-proof device for detecting a magnetic pulse generated from a magnetic wire has been described in JP-A-2006-256124 Publication and is well-known, for instance.

(H04) Although the structure using the one-way hinge has been described as an embodiment of the braking member in the embodiments, it is preferable that the one-way hinge should be used and it is also possible to use a torque limiter for carrying out braking in both normal and reverse rotating directions, for instance. In addition, it is also possible to use, as the braking member, a buffer for increasing a load resistance corresponding to an increase in a speed, that is, a so-called damper.

(H05) Although the rail-shaped guided rails 21, 22, 21' and 22' have been described as an embodiment of the pull-out member in the embodiments, the invention is not restricted to the structure but it is possible to use the conventionally well-known structure in which a movement can be carried out in the pull-out direction as in a so-called slider.

(H06) Although the toner cartridges Kg to Kk employ the structure in which the cartridge shutter Kk4 is moved in the circumferential direction along the circumferential surface in the embodiments, the invention is not restricted to the structure but it is also possible to employ a structure in which the movement can be carried out in the pull-out direction and an opening/closing operation is performed in the movement between the pull-out position and the accommodating position, for instance. In the case in which the structure is employed, the toner cartridge does not need to be rotated over the holding member body (36+61). Therefore, the handle rotating ports 63*a* and 76*a* are not fan-shaped but can take a shape of a groove in a vertical direction through which the handle Kk6 can pass. The handle lock 81 can also be omitted.

(H07) Although it is desirable to employ the structure in which the guided rails 21 and 22 are held in the pull-out position in the state in which the link 27 is provided and the tilting holder 31 is not moved to the insertion enabling position in the embodiments, it is also possible to omit the structure.

(H08) Although it is desirable to employ the structure in which an operator is caused to be conscious of the movement to the insertion enabling position through hanging carried out by the hanging portion 42*d* and the latch hole 51 or the tilting holder 31 is aided to be held in the insertion enabling position in the embodiments, it is also possible to omit the structure. Although the combination of the pin 42 and the latch hole 51 has been employed, moreover, the invention is not restricted to the structure but it is also possible to have the conventionally well-known optional structure, for instance, a combination of a hook and a hole or a hook and a pin. Although the pin 42 is provided on the holder frame 36 and the latch hole 51 is provided on the supports 46 and 47, moreover, it is also possible to provide a latch hole on the holder frame 36 and to provide a pin on a support.

(H09) Although it is desirable to employ the structure in which the rotation locking surface 54*a* and the support coupling stud 44 are fitted in by the rotary interlocking motion of the supports 46 and 47 and the front cover 71, and the tilting holder 31 is locked in a rotation disabling state if the front cover 71 is not moved to the front end closing position in the embodiments, it is also possible to omit the structure.

(H010) Although the description has been given to the structure in which the cartridge handle Kk6 is operated to enable a movement from the pull-out position to the accommodating position by the contact of the push-in rib Kk7 with the rib contact portion 62*b* in the embodiments, the invention is not restricted to the structure but an optional structure can be employed for the push-in structure. For instance, it is also possible to employ a structure in which the front end of the toner cartridge Kk is perfectly covered with the front cover and an operating portion is provided in the front cover 71 to push in the front cover 71, thereby enabling a movement toward the accommodating position.

(H011) Although it is desirable that the holder cover 61 should be provided in the embodiments, it is also possible to omit the holder cover 61 or to provide each portion of the holder cover 61 in the holder frame 36.

(H012) Although the description has been given to the structure in which the rotation of the front cover 71 and the supports 46 and 47 are interlocked with each other by the lock stud 78 and the lock opening 56 in the embodiments, it is desirable to provide the structure. By an omission, however, it is also possible to employ a structure in which a movement can be carried out independently. Moreover, the invention is not restricted to the combination of the lock stud 78 with the opening 56 but it is also possible to provide an optional interlocking mechanism or to provide the stud 78 on the supports 46 and 47 and to provide an opening on the front cover.

(H013) In the embodiments, the shape of the handle lock 81 is not restricted to the structure described in the embodiments but can be changed depending on a design or a specification.

(H014) In the embodiments, there is a possibility that the rotating position might be shifted from the outlet closing position to the outlet opening position side when the toner cartridges Kk to Kg are attached via the handle passing port 63*b*. In order to cope with the foregoing, it is desirable to incorporate a mechanism for rotating the toner cartridges Kk to Kg to the outlet closing position when closing the front cover 71. For instance, it is also possible to provide, in the handle lock 81, a cam to be rotated in contact with the front ends of the toner cartridges Kk to Kg, thereby carrying out a movement to the outlet closing position with an operation for closing the front cover 71.

What is claimed is:

1. A removable member-holding device comprising:

a pull-out member being movably between an accommodating position in which the pull-out member is accommodated in an image forming apparatus body and a pull-out position in which the pull-out member is pulled out of the image forming apparatus body outward from the accommodating position along a pull-out direction thereof;

a holding member supported on the pull-out member and having a holding member body, the holding member being extended in a moving direction of the pull-out member and holding a removable member which is removed from the image forming apparatus body, the holding member being movable between an insertion enabling position in which the pull-out member can be moved from the pull-out position toward the accommodating position and a removing position in which at least a downstream side of the holding member in the pull-out direction is moved downward in a direction of a gravity with respect to the insertion enabling position so that the removable member can be removed; and a pull-out regulating member provided on a downstream end of the holding member in the pull-out direction and regulating a movement of the removable member to a downstream side in the pull-out direction.

2. The removable member-holding device according to claim 1, further comprising a front end opening and closing member which has the pull-out regulating member, is rotatably supported on the downstream end of the holding member in the pull-out direction, and is rotated and moved between a front end opening position in which the removable member can be removed from the holding member and a front end closing position in which the downstream end, in the pull-out direction, of the removable member held on the holding member is covered.

3. The removable member-holding device according to claim 2, further comprising:

an operating portion provided on the downstream end of the movable member in the pull-out direction; and a passing port which is provided on the front end opening and closing member, wherein when the front end opening and closing member is moved to the front end closing position in a state in which the removable member is attached to the holding member body, the operating portion of the removable member passes the passing port so that the operating portion can be operated at a further downstream side of the pull-out regulating member in the pull-out direction, the operating portion passing forward in the pull-out direction from the passing port being operated to move the holding member and the pull-out member toward the accommodating position.

4. The removable member-holding device according to claim 3, further comprising:

a push-in received portion provided on the holding member; and a push-in transmitting portion provided in the removable member, the push-in transmitting portion coming in contact with the push-in received portion in a state in which the removable member is attached to the holding member.

5. The removable member-holding device according to claim 4, wherein the holding member is supported rotatably around a rotating shaft with respect to the pull-out member and supported rotatably between the insertion enabling position and the removing position;

wherein the removable member-holding device further comprises:

a rotation regulating portion provided in a position placed apart from the rotating shaft of the holding member;

an auxiliary rotor supported rotatably around an auxiliary rotating shaft disposed in a position placed apart from the rotating shaft of the holding member;

a lower rotation regulating portion provided in a position placed apart from the auxiliary rotating shaft of the auxiliary rotor and holding the holding member in the removing position in engagement with the rotation regulating portion of the holding member moved to the removing position and to regulate a further downward rotation in the direction of the gravity from the removing position of the holding member;

an opening rotation regulating portion provided in a position placed apart from the lower rotation regulating portion of the auxiliary rotor;

a rotation interlocking portion provided in the front end opening and closing member and rotated and moved with a rotating movement of the front end opening and closing member; and a rotation interlocked portion provided in the auxiliary rotor and coupled to the rotation interlocking portion, moving the auxiliary rotor from a lower rotation regulating position in which the rotation regulating portion comes in contact with the lower rotation regulating portion to a rotation regulating position in which a rotation from the removing position of the holding member is regulated in engagement of the rotation regulating portion with the opening rotation regulating portion interlockingly with a movement of the front end opening and closing member from the front end closing position to the front end opening position, and moving the auxiliary rotor from the rotation regulating position to the lower rotation regulating position interlockingly with a movement of the front end opening and closing member from the front end opening position to the front end closing position.

6. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 5.

7. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 4.

8. The removable member-holding device according to claim 3, wherein the holding member supports the removable member rotatably around a removable member central axis extended in the pull-out direction, and the passing port includes a fan-shaped opening corresponding to a rotation enabling range of the movable member, wherein the removable member-holding device further comprises a rotation stopping member which is supported on the front end opening and closing member corresponding to the passing port, is supported movably between a rotation stopping position in which the rotation stopping member regulates a rotation of the removable member in contact with the operating portion of the removable member and a rotation permitting position in which the rotation stopping member is moved from the rotation stopping position to the downstream side in the pull-out direction to separate from the operating portion of the removable member so as to permit the rotation of the removable member, and is held in the rotation stopping position in a state in which the pull-out member is moved to the pull-out position and is moved from the rotation stopping position to the rotation permitting position before the pull-out member is moved to the accommodating position.

9. The removable member-holding device according to claim 8, wherein the holding member is supported rotatably around a rotating shaft with respect to the pull-out member and supported rotatably between the insertion enabling position and the removing position;

wherein the removable member-holding device further comprises:

a rotation regulating portion provided in a position placed apart from the rotating shaft of the holding member;

an auxiliary rotor supported rotatably around an auxiliary rotating shaft disposed in a position placed apart from the rotating shaft of the holding member;

a lower rotation regulating portion provided in a position placed apart from the auxiliary rotating shaft of the auxiliary rotor and holding the holding member in the removing position in engagement with the rotation regulating portion of the holding member moved to the removing position and to regulate a further downward rotation in the direction of the gravity from the removing position of the holding member;

an opening rotation regulating portion provided in a position placed apart from the lower rotation regulating portion of the auxiliary rotor;

a rotation interlocking portion provided in the front end opening and closing member and rotated and moved with a rotating movement of the front end opening and closing member; and a rotation interlocked portion provided in the auxiliary rotor and coupled to the rotation interlocking portion, moving the auxiliary rotor from a lower rotation regulating position in which the rotation regulating portion comes in contact with the lower rotation regulating portion to a rotation regulating position in which a rotation from the removing position of the holding member is regulated in engagement of the rotation regulating portion with the opening rotation regulating portion interlockingly with a movement of the front end opening and closing member from the front end closing position to the front end opening position, and moving the auxiliary rotor from the rotation regulating position to the lower rotation regulating position interlockingly with a movement of the front end opening and closing member from the front end opening position to the front end closing position.

10. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 9.

11. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 8.

12. The removable member-holding device according to claim 3, wherein the holding member is supported rotatably around a rotating shaft with respect to the pull-out member and supported rotatably between the insertion enabling position and the removing position;

wherein the removable member-holding device further comprises:

a rotation regulating portion provided in a position placed apart from the rotating shaft of the holding member;

an auxiliary rotor supported rotatably around an auxiliary rotating shaft disposed in a position placed apart from the rotating shaft of the holding member;

a lower rotation regulating portion provided in a position placed apart from the auxiliary rotating shaft of the auxiliary rotor and holding the holding member in the removing position in engagement with the rotation regulating portion of the holding member moved to the removing position and to regulate a further downward rotation in the direction of the gravity from the removing position of the holding member;

an opening rotation regulating portion provided in a position placed apart from the lower rotation regulating portion of the auxiliary rotor;

a rotation interlocking portion provided in the front end opening and closing member and rotated and moved with a rotating movement of the front end opening and closing member; and a rotation interlocked portion provided in the auxiliary rotor and coupled to the rotation interlocking portion, moving the auxiliary rotor from a lower rotation regulating position in which the rotation regulating portion comes in contact with the lower rotation regulating portion to a rotation regulating position in which a rotation from the removing position of the holding member is regulated in engagement of the rotation regulating portion with the opening rotation regulating portion interlockingly with a movement of the front end opening and closing member from the front end closing position to the front end opening position, and moving the auxiliary rotor from the rotation regulating position to the lower rotation regulating position interlockingly with a movement of the front end opening and closing member from the front end opening position to the front end closing position.

13. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 12.

14. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 3.

15. The removable member-holding device according to claim 2, wherein the holding member is supported rotatably around a rotating shaft with respect to the pull-out member and supported rotatably between the insertion enabling position and the removing position;

wherein the removable member-holding device further comprises:

a rotation regulating portion provided in a position placed apart from the rotating shaft of the holding member;

an auxiliary rotor supported rotatably around an auxiliary rotating shaft disposed in a position placed apart from the rotating shaft of the holding member;

a lower rotation regulating portion provided in a position placed apart from the auxiliary rotating shaft of the auxiliary rotor and holding the holding member in the removing position in engagement with the rotation regulating portion of the holding member moved to the removing position and to regulate a further downward rotation in the direction of the gravity from the removing position of the holding member;

an opening rotation regulating portion provided in a position placed apart from the lower rotation regulating portion of the auxiliary rotor;

a rotation interlocking portion provided in the front end opening and closing member and rotated and moved with a rotating movement of the front end opening and closing member; and a rotation interlocked portion provided in the auxiliary rotor and coupled to the rotation interlocking portion, moving the auxiliary rotor from a lower rotation regulating position in which the rotation regulating portion comes in contact with the lower rotation regulating portion to a rotation regulating position in which a rotation from the removing position of the holding member is regulated in engagement of the rotation regulating portion with the opening rotation regulating portion interlockingly with a movement of the front end opening and closing member from the front end closing position to the front end opening position, and moving the auxiliary rotor from the rotation regulating position to the lower rotation regulating position interlockingly with a movement of the front end opening and closing member from the front end opening position to the front end closing position.

16. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 15.

17. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 2.

18. An image forming apparatus comprising:

an image holding member;

a developing device for developing, into a visible image, a latent image on a surface of the image holding member;

a removable member including a developer housing container in which a developer to be supplied to the developing device is accommodated; and a removable member-holding device according to claim 1.

* * * * *